US005647407A

United States Patent [19]

Scott et al.

[11] Patent Number: 5,647,407

[45] Date of Patent: Jul. 15, 1997

[54] ELECTRONIC SYSTEM FOR CONTROLLING A TENSIONING APPARATUS

[75] Inventors: Ernest D. Scott, Delray Beach, Fla.; Donald L. Tedder, Carrollton, Ga.; Gregory W. Scott, Jacksonville Beach, Fla.; John Kohls; Richard Kohls, both of Pinellas Park, Fla.

[73] Assignee: Edge Technology Corporation, Delray Beach, Fla.

[21] Appl. No.: 471,824

[22] Filed: Jun. 7, 1995

Related U.S. Application Data

[60] Division of Ser. No. 400,289, Mar. 3, 1995, which is a continuation-in-part of Ser. No. 66,945, May 25, 1993, abandoned, which is a continuation-in-part of Ser. No. 621,215, Nov. 30, 1990, Pat. No. 5,212,928, which is a continuation-in-part of Ser. No. 626,426, Dec. 17, 1990, Pat. No. 5,031,943, which is a continuation-in-part of Ser. No. 503,281, Apr. 2, 1990, abandoned.

[51] Int. Cl.[6] ..... B21F 9/02

[52] U.S. Cl. ..... 140/123.5; 140/93.2

[58] Field of Search ..... 140/123.5, 123.6, 140/93.2; 53/138.3, 138.6, 139.1, 417

[56] References Cited

U.S. PATENT DOCUMENTS

| | | | |
|---|---|---|---|
| 3,515,178 | 6/1970 | Hidassy | 140/123.6 |
| 3,865,156 | 2/1975 | Moody | 140/123.6 |
| 3,931,838 | 1/1976 | Bakermans | 140/123.6 |
| 3,946,769 | 3/1976 | Caveney | 140/123.6 |
| 4,015,643 | 4/1977 | Cheung | 140/123.5 |
| 4,371,010 | 2/1983 | Hidassy | 140/93 A |
| 4,498,506 | 2/1985 | Moody | 140/93 A |
| 4,747,433 | 5/1988 | Dixon | 140/123.5 |
| 4,862,928 | 9/1989 | Caveney | 140/93.2 |
| 4,934,416 | 6/1990 | Tonkiss | 140/123.6 |

*Primary Examiner*—Daniel C. Crane

*Attorney, Agent, or Firm*—Malin, Haley, DiMagio & Crosby

[57] ABSTRACT

An electronic system for controlling the operation of a hand-held pull strap closure unit. The system includes a central processing unit which controls peripheral circuitry for directing commands to a motor within the hand-held unit. The system further includes a circuit for monitoring motor torque and a hand-held unit identification circuit for identifying each unit with an individualized code. The CPU may be accessed via an external communications port to store user-selected operational parameters in a memory circuit. These parameters may include time of day, calendar, and motor torque limits for each device.

6 Claims, 32 Drawing Sheets

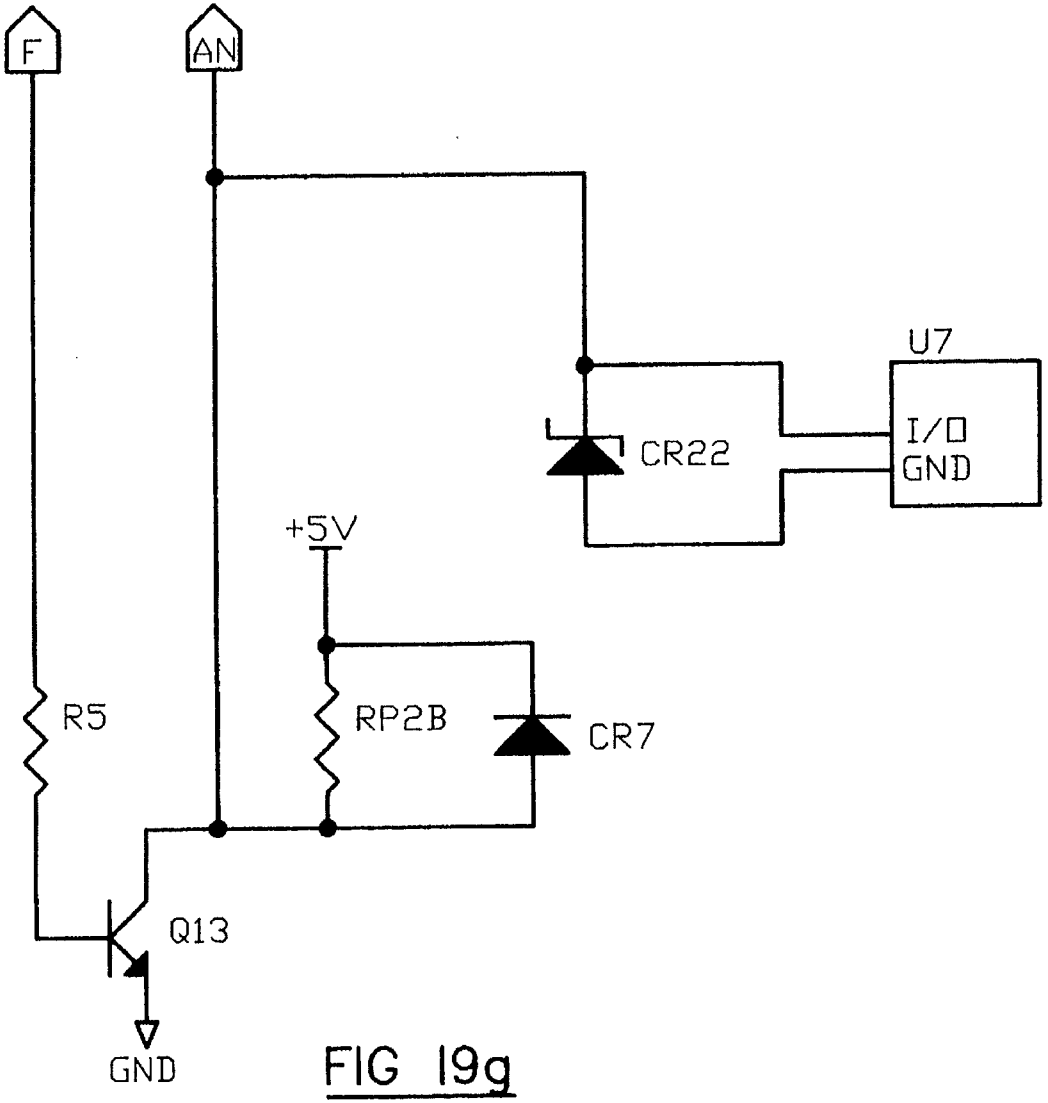
FIG 19g
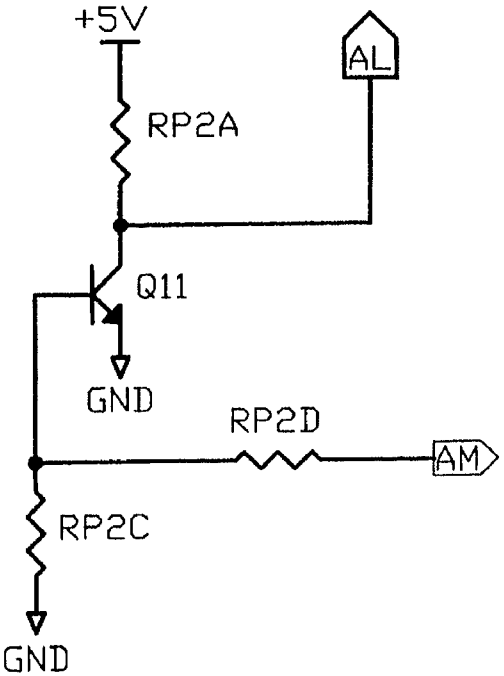

ELECTRONIC SYSTEM FOR CONTROLLING A TENSIONING APPARATUS

This is a division of copending application Ser. No. 08/400,389 filed on Mar. 3, 1995 which is a CIP of application Ser. No. 08/066,945 filed May 25, 1993, now abandoned, which is a CIP of application Ser. No. 07/621,215 filed Nov. 30, 1990 which issued into U.S. Pat. No. 5,212,928 which application was a CIP of application Ser. No. 07/626,426 filed Dec. 17, 1990 which issued as U.S. Pat. No. 5,031,943 which application was a CIP of application Ser. No. 07/503,281 filed Apr. 2, 1990, now abandoned.

BACKGROUND OF THE INVENTION

1. Field of the Invention

This invention relates generally to an apparatus for tensioning a strap, one such strap being disclosed in U.S. Pat. No. 3,022,557, and more particularly relates to a convenient, hand-held automatic tensioning apparatus adapted to tension, among other things, a one-piece bundling strap manufactured from a single material having means to ensure the firm gripping of the tail end of said strap within the apertured self-clinching head end portion thereof against reverse movement of the strap body relative to said head-end portion, means being associated with said bundling strap to indicate the presence of tampering.

2. Description of the Prior Art

Devices for tensioning and securing such straps about the neck of a bank bag or other item(s) to be bundled have heretofore been exclusively manually operable and cumbersome. These devices have primarily been hand-operated seal presses utilizing a fabric-type cord secured in taut relationship about the neck of the currency bag by means of a quantity of lead which is crimped by the hand-operated seal press and thereby deformed, forming a tight grip about said cord. An example of this type of hand-operated seal press is embodied in U.S. Pat. No. 3,911,970 to Lundberg et al. The process of bundling the neck of a currency bag using these hand-operated devices is extremely time consuming and manually intensive.

A radical improvement in the state of the art strap tensioning field is presented in applicants' U.S. Pat. No. 4,901,775, which is hereby incorporated by reference herein and set forth in part hereafter.

Flexible bundling straps adapted to be looped about a plurality of loose elements or about the neck of a flexible container and drawn taught thereabout in self-clinching relationship are well known. Bundling or tie straps of this nature are comprised of an elongated flexible strap adapted to be wrapped around a plurality of items to be bundled or about a pouch to be sealed (eg: cloth bag or money-carrying bag), pulled taut and held taut by a relatively rigid tongue disposed within the head-end of the strap. The head-end has a through-aperture therein adapted to receive the opposite or tail-end of said strap, said tongue adapted to coact with the tail-end of said strap so as to retain the strap against reverse movement thereof.

An example of a tie or bundling strap of this nature is disclosed in U.S. Pat. No. 3,186,047 to Schwester et al. The apertured head-end portion of Schwester has a self-clinching tongue means but which must be inserted into the head-end portion at a predetermined angle using an additional step in the process of manufacturing the strap, increasing the cost thereof. Undetected tampering may be accomplished by prying and removing the tongue means from clinching engagement with the strap body using a thin, sharp implement, and slipping the strap out of the aperture in the head-end. Tampering may also be accomplished by deforming the head-end, thereby releasing the tongue. This would allow the bundled items to be unbundled or the closed pouch to be opened and access gained to the interior thereof. Thereafter the items may be rebundled or pouch reclosed using the same strap without evidence of tampering.

A further effort at providing a tamper-proof bundling strap of the type here under consideration is disclosed in applicants' U.S. Pat. No. 4,902,055, which is directed to a security cap adapted to cover the head-end portion of the bundling strap and thereby preclude access to said tongue means. The cover is comprised of a generally flat sheet of semi-rigid or rigid material bent along transverse axes into a three-dimensional generally rectangular member. Through openings are provided therein which correspond with the positions through which the thin bundling strap body is passed when in use. Such a structure, however, is relatively costly to produce and time consuming and cumbersome to use, but is nevertheless effective.

It is therefore a principal object of the present invention to provide a means for automatically and rapidly securing a self-clinching bundling strap about the neck of a flexible container or other item(s) to be bundled.

It is a further object of the present invention to provide a method for automatically tightening a novel bundling strap about the neck of a currency bag using an apparatus which is lightweight and accomplishes its task consistently and a multiple of times faster than the heretofore hand-operated devices.

It is also a principal object of the instant invention to provide an improved self-clinching tamper-proof bundling strap.

It is a further object of the present invention to provide a tamper-proof self-clinching bundling strap having locking means wherein the body portion thereof is adapted to be locked by a novel and inexpensive locking means against reverse movement throughout its length when looped upon itself and drawn through its apertured head-end portion.

It is a still further object of the present invention to provide a novel tamper-proof self-clinching bundling strap manufactured as a single piece from a relatively brittle material which will fracture when exposed to predetermined tampering forces.

It is still a further object of the invention to provide an electronic circuit including a processor unit to provide control for the electric tensioning device.

SUMMARY OF THE INVENTION

There is disclosed herein a tamper-proof bundling strap comprised of a head-end portion defining an aperture therethrough, said head-end portion being integrally connected to an elongated narrow body portion, said aperture in said head-end portion corresponding generally to the cross-sectional configuration of said body portion. The head-end portion and the body portion comprise a locking means integrally associated therewith for preventing reverse movement of said body portion relative to said head-end portion when said body portion is looped upon itself and disposed within the aperture of said head-end portion. The locking means is comprised of a plurality of serrations or ratchet teeth oriented along a portion of the length of said body portion and a plurality of projecting teeth members or pawls disposed within said through aperture adapted to lock against reverse movement of said serrations therethrough when said body portion is drawn through the aperture in the head-end portion.

The strap is a one-piece unit constructed of a single, relatively brittle, material which will fracture when exposed to tampering forces. The strap of the instant invention is ideally suited for use with the applicants' automatic seal tensioning machine disclosed in their U.S. Pat. No. 4,901,775.

To this end, the tail-end of the body portion may be tapered to facilitate unencumbered placement of the body portion within the jaws of the automatic tensioning device. The teeth members of the locking means project into the aperture in said head-end portion at an angle such that the body portion can be passed through the head-end in one direction with minimal resistance but cannot be moved in the reverse direction because the outer surfaces of said teeth members mate in planar association with a steep trailing surface of any given serration, thereby preventing the body portion from being removed from said head-end portion.

Detents may be disposed in the body portion of the strap, thereby creating stress raisers along which the strap will fracture if tampered with.

The bundling apparatus used to carry out the method of this invention is comprised of a hand-operated automatic tensioning machine for pulling taut to a predetermined tension a self-clinching bundling strap about an article to be protected such as the neck of a currency bag. The machine is comprised generally of a means for rotating an output shaft, as for example a hand-held electric screwdriver motor and hand-held housing unit therefore, having associated therewith an on/off switch normally biased to the "off" position, said output shaft being coupled to an externally threaded rod which is disposed to rotate about its elongate axis by way of a bearing means at the end of said rod opposite the coupling with said output shaft. An internally threaded guide block means is disposed for linear reciprocal movement along the elongate length of said externally threaded rod. Means for gripping the body portion of said strap are rotatably associated with said guide block means. As the threaded rod rotates, the threads thereon rotate, causing the guide block means to move linearly by virtue of the meshing interconnection of the rod threads with the internal threads of the guide block means.

In use, the strap body is looped about the item(s) to be bundled, and the tail end of the strap body brought into engagement with the gripping means. Thereafter, movement of the guide block means away from item(s) causes said gripping means to firmly engage, and preferably roll mark the strap body with identifying indicia, while pulling the strap body taut to a predetermined tension.

The shaft/gripping means arrangement is positioned within a protective housing means which corresponds generally with the elongate axis of said rod and connects to the output shaft-end of said hand-held reversible motor housing unit to form one integral unit therewith.

It should be noted that for purposes of this disclosure, "distal" shall mean toward the left in the figures and "proximal" shall mean toward the right in the figures. The distal end of said housing means defines an aperture corresponding generally to the shape of the body portion of said bundling strap so that the tail-end of said bundling strap may be passed through said aperture and placed into locking engagement with said gripping means, which gripping means is positioned at the distal end of said rod when the sealing operation is commenced. The machine means is then actuated, the output shaft and rod begin to rotate, which thereby causes the gripping means to move linearly toward said machine means and away from said currency bag, thereby pulling the bundling strap along with it because of frictional interconnection between said gripping means and the strap body. The bundling strap has already been placed about the open neck of a currency bag or other item(s) to be bundled. The gripping means is drawn backwardly along said rod so as to pull the bundling strap tightly through the head end portion of said strap and around the neck of the currency bag or other item(s) to be bundled. Self-clinching means are provided within the bundling strap so that the strap will remain tight about the bundled bag without loosening. The self-clinching means may be, for example, a semi-rigid sharp projection which engages the body of the tautly sharp projection which engages the body of the tautly pulled bundling strap against reverse (or loosening) movement.

The hand-held unit is provided with a power means having adjustable automatic shut-off and reverse direction features which are actuated when the gripping means fully reaches both the proximal and distal ends of the threaded rod or when it reaches said predetermined tension so as to avoid producing undue stresses within the invention as a whole or any of its components.

The instant invention also comprises a method for drawing a bundling strap taut about the neck of a flexible container such as a bank bag, comprised of the steps of:

looping a bundling strap about the open neck of a flexible container;

inserting the tail end of the strap through an aperture defined in the head-end portion of the strap;

pulling said tail-end of said strap completely through said aperture until at least the first set of serrations disposed along opposed side edges of the strap body are engaged by teeth members projecting upwardly into the interior of the aperture, thereby locking the strap body against reverse movement relative to said head-end portion;

inserting the tail-end portion of the strap between a pair of strap body gripping jaws which are disposed for reciprocal movement within an automatic bundling strap tensioning apparatus, said gripping jaws adapted to move linearly between an extended position and a retracted position;

causing said position gripping jaws to move from the extended to the retracted position, thereby pulling the strap body through said aperture and closing the neck of the flexible container;

causing said gripping jaws to move from the retracted toward the extended position to release the strap body from engagement between said gripping jaws.

A further step may be added to the above recited method of imprinting the strap body with indicia using indicia printing means associated with said gripping jaws adapted to imprint indicia upon the strap body, preferably at indicia receiving area "T" located on the strap body.

The invention will now be described in detail with particular reference to the following drawing figures.

In accordance with these and other objects which will be apparent hereinafter, the instant invention will now become described with particular reference to the accompanying drawings.

BRIEF DESCRIPTION OF THE DRAWINGS

FIGS. 19*a*–19*i* is a schematic diagram of the central processor unit, memory circuit, motor clutch sensing circuit, handpiece I.D. circuit, power on reset circuit, operator interface, external communication port, and DC power supply circuit.

DESCRIPTION OF THE PREFERRED EMBODIMENTS

Figure 2:
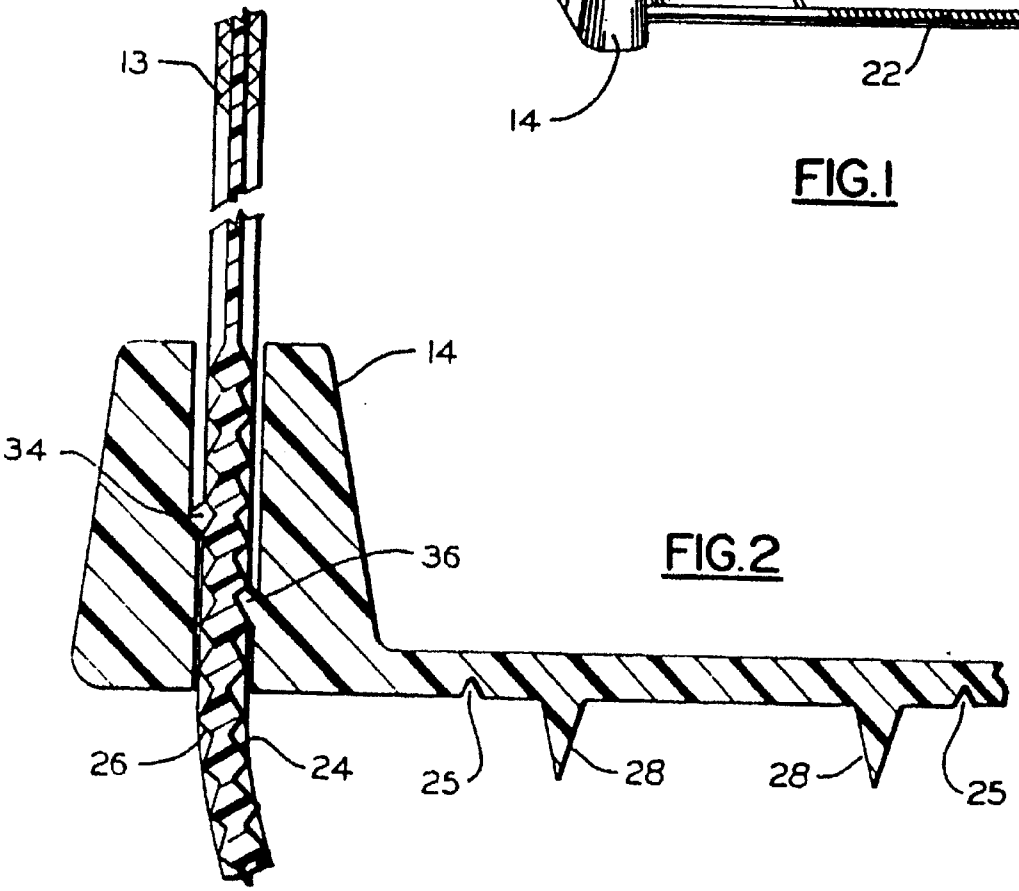
FIG. 2 is a partial sectional view thereof taken along lines 2—2 of FIG. 1.
Figure 6:
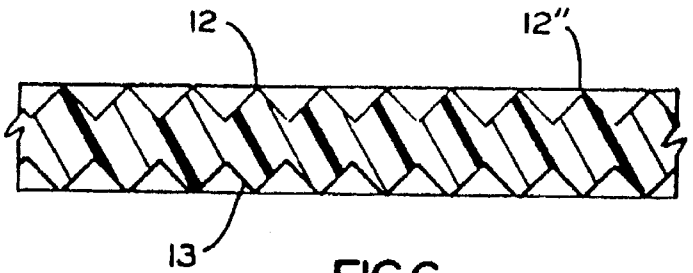
FIG. 6 is a partial cross-sectional view taken along lines 6—6 of FIG. 1.

Referring to the drawings, the improved bundling or tie-strap is referred to throughout generally by the reference numeral 10. Said strap 10 is comprised of a narrow elongated body portion 12 having integrally connected at its head-end 12' a head-end member 14 which defines an H-shaped aperture 30 therein corresponding generally to the cross-sectional dimensions of said body portion 12. Tail end 12" of strap portion 12 may have integrally formed therein a plurality of spaced, parallel, relatively narrow grooves 13 to act as a finger grip portion. Serrations 22 are provided along the sides of both top and bottom surfaces of strap body 12 extending from a point near head end 14 and ending at area "I", and are adapted to coact with projecting teeth members 34 and 36 disposed within aperture 30 of head-end 14. The profile of each serration is preferably that of an oblong diamond, wherein the leading surface 24 thereof is longer than the trailing surface 26. The pitch of trailing surface 26 is preferably generally parallel to the mating surface 34' or 36' of projecting teeth members 34 and 36, respectively, when body portion 12 is disposed within aperture 30 of head-end 14. The pitch of the leading surface 24 is longer and less steep in profile to facilitate the insertion of body member 12 into and through aperture 30. Teeth members 34 and 36 are angled as seen in FIG. 2 to allow the strap body 12 to pass thereover during insertion into the head 14 but to prevent removal thereof in the opposite direction.

Teeth 34 and 36 mesh tightly with trailing surfaces 26 so as to prevent tampering with said teeth. Teeth 34 and 36 are also hidden by surfaces 24 and 26 providing a shield against tampering.

Figure 5:
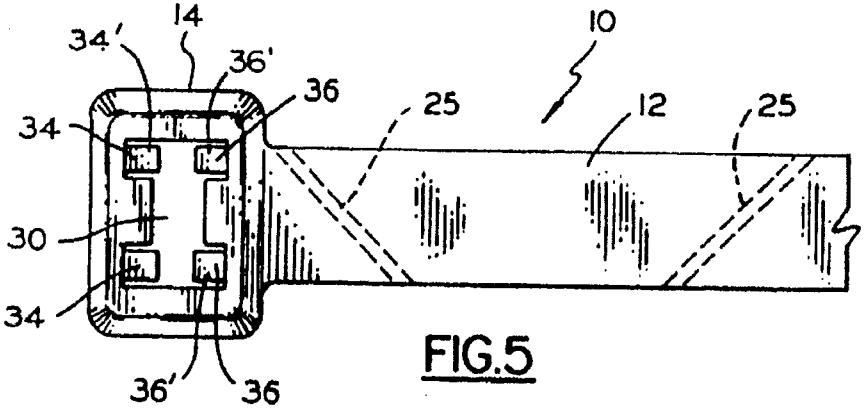
FIG. 5 is a partial plan view showing the head-end portion and teeth members therein.

As best seen in FIG. 5, teeth members 34 and 36 are preferably formed out of the material of strap 10 as through injection molding, casting, or stamping into the preformed strap. In the preferred embodiment, teeth members 34 and 36 are formed integrally with head-end 14 near the outer side edges of aperture 30 and thereby in corresponding position with serrations 22 near the outer sides of strap body 12. Said teeth may in the alternative be positioned more closely to each other and the serrations positioned correspondingly on strap body 12. However, it is preferred that a blank area be left as at I in FIG. 1 to accommodate the imprinting of identification indicia thereon. For example, the strap of the instant invention may be used with the automatic strap tensioning apparatus shown in FIGS. 8–15 and depicted in phantom as 50 in FIG. 3. The gripping jaws 84 and 85 of that apparatus grip strap body 12 near tail end 12" and pull strap 10 taut about the item or items to be bundled. Said jaws 84 and 85 may be provided with raised markings on at least one of their opposed gripping surfaces which will leave an impression on the strap body in indicia marking area "I" for identification when the jaws are translated rearwardly during the tensioning operation, described in fuller detail below. Also, or in the alternative, indicia may be imprinted upon head 14 in any convenient manner.

Referring now to FIGS. 3 and 8–12, reference numeral 50 designates the automatic seal tensioning machine which is comprised of a hand-held unit 54 housing a reversible motor M1 (not shown) having a rotating output shaft 56. The motor M1 is preferably actuatable by a normally open on/off switch controlled by trigger 55. The motor is powered and controlled logically by a remote controller unit 120, to be described more fully hereinafter. Remote controller 120 is electrically communicated to said automatic seal machine 50 by means of an electrical cable or the like. Pin connectors or other suitable electrical connecting means 121 may be employed to communicate cable 58 with the motor M1 and with remote controller unit 120.

Figure 10:
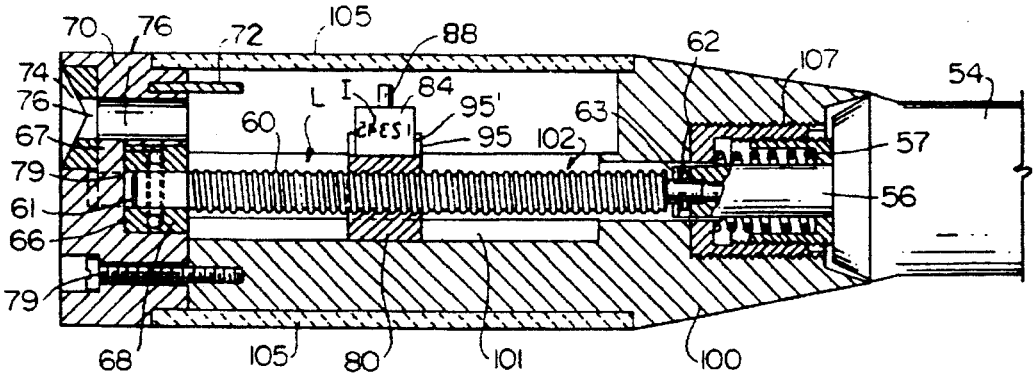
FIG. 10 is an elevational cross-sectional view of the tensioning apparatus taken along lines 10—10 of FIG. 8.

Output shaft 56 of said motor M1 is coupleable to a rotatable threaded elongated rod 60, preferably by means of a transverse pin 62 which is sized and shaped to engage a corresponding detent 63 disposed within the end of output shaft 56, as best shown in FIG. 10.

Figures 8, 8A:
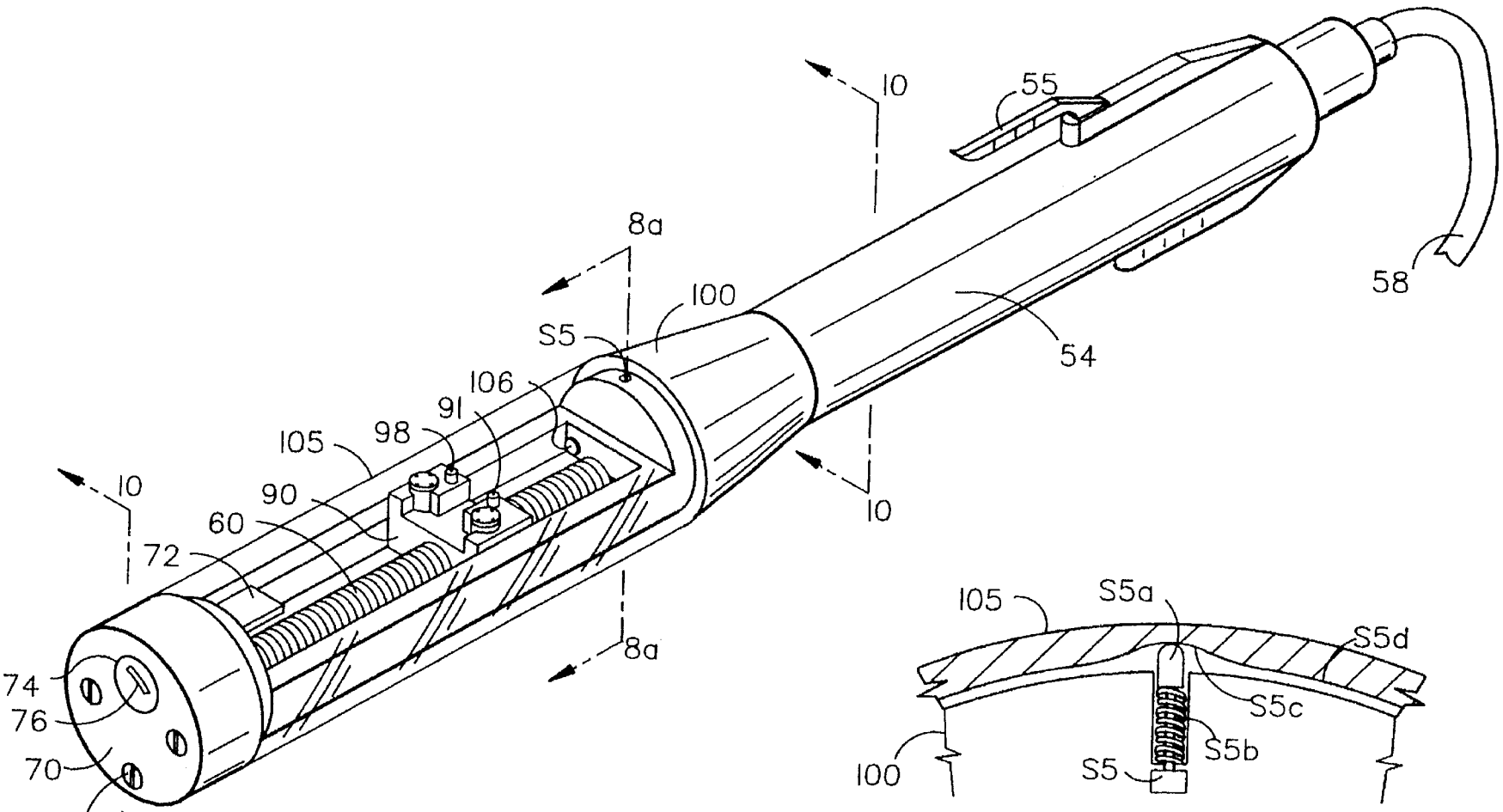
FIG. 8 is a perspective view of the tensioning apparatus of this invention.
FIG. 8*a* is a cross sectional view as shown through section lines 8*a*—8*a* shown in FIG. 8.
Figure 9:
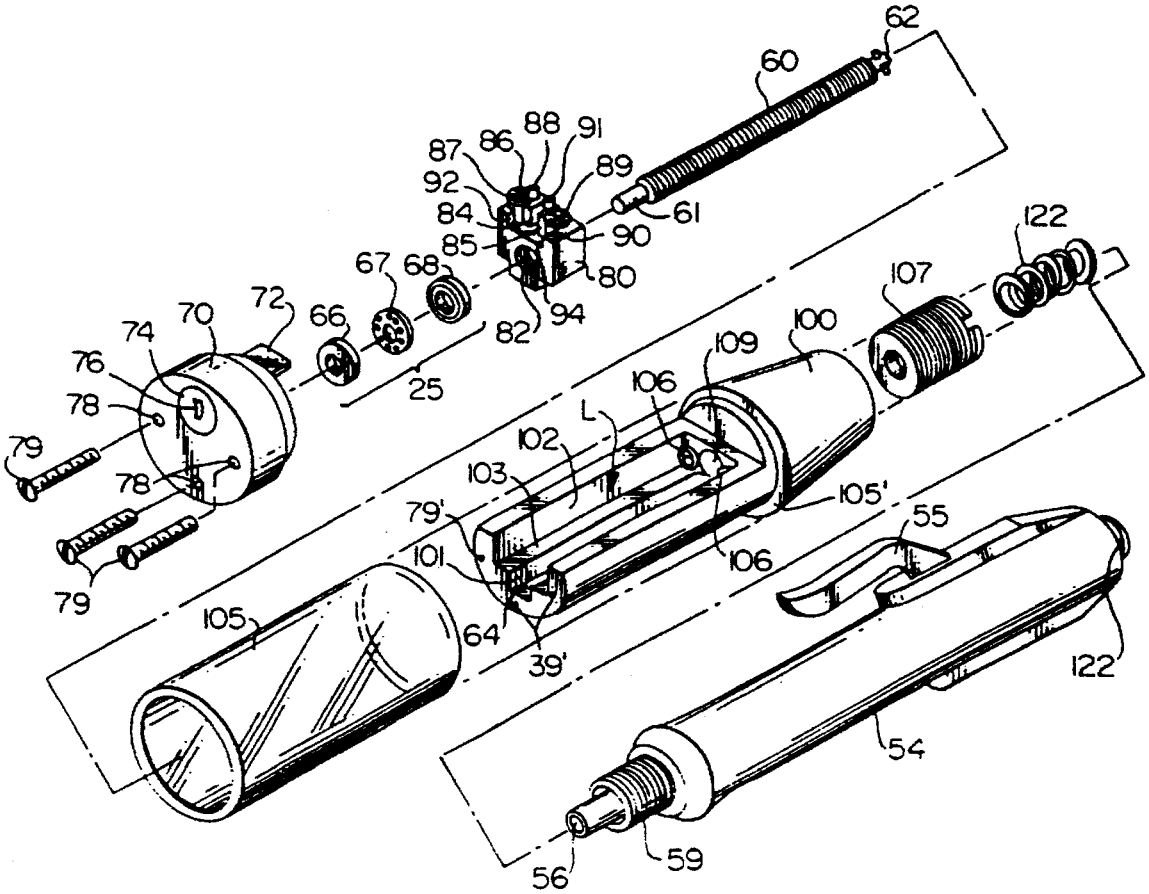
FIG. 9 is an exploded view of the tensioning apparatus showing the interior detail thereof.
Figure 9A:
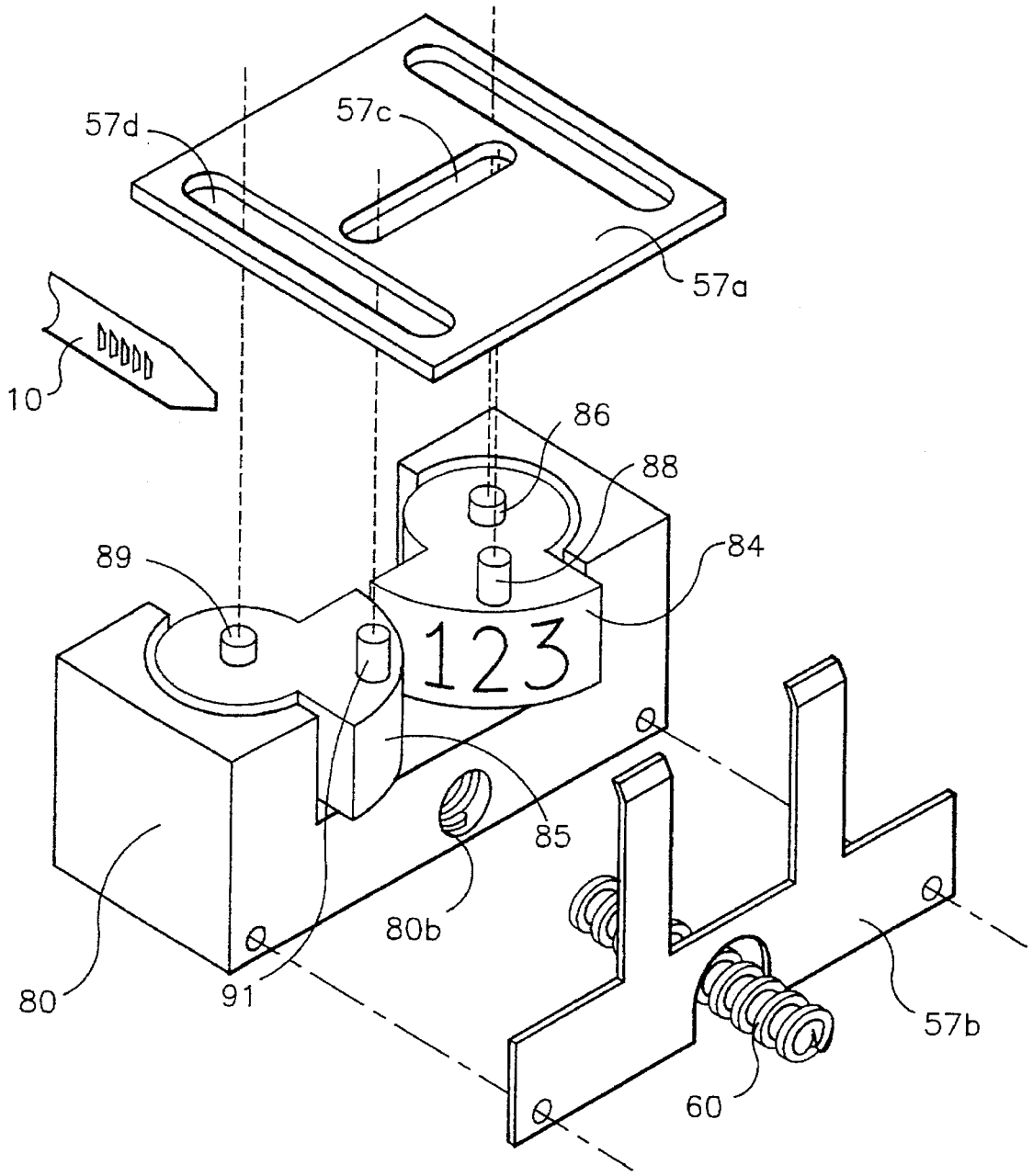
FIG. 9*a* is an exploded view of the guide block shown in FIG. 9.

Referring now to FIGS. 8–10, hand-held unit 54 is provided with external threads 59 at its distal end which are adapted to engage in mating contact an internally threaded collar 107 threadingly connected to shaft housing 100. Housing 100 is configured to generally surround the apparatus of the strap tensioning mechanism in a manner which will be set forth herein. Housing 100 is comprised of a generally cylindrically shaped body portion, which may have a tapering proximal end portion. Housing 100 is adapted to join hand-held unit 54 in threading engagement at threads 59 and 59'. Sandwiched therebetween is slip-clutch spring 57 which provides compressive force against a slip-clutch mechanism disposed within hand-held unit 54 in a conventional manner. In the preferred embodiment, internally and externally threaded collar 107 mates housing 100 with threads 59' of hand-held unit 100. Spring 57 contacts collar 107 at the distal end thereof. The position of collar 107 within housing 100 is adjustable by turning said collar 107 either clockwise or counterclockwise when viewed from its proximal end depending upon whether it is desired to increase or decrease the force exerted by spring 57 between housing collar 107 and hand-held unit 54. Increasing the force borne by spring 57 increases the pressure on the hand-held unit motor slip clutch (not shown) which in turn increases the amount of tensioning force which said motor may exert on a bundling strap being tensioned before said slip clutch will fail to provide any gripping force and allow the motor in unit 54 to spin freely. In an alternative embodiment, the adjustment feature of collar 107 would be replaced by interchangeable springs 57 having differing spring constants.

Figure 11:
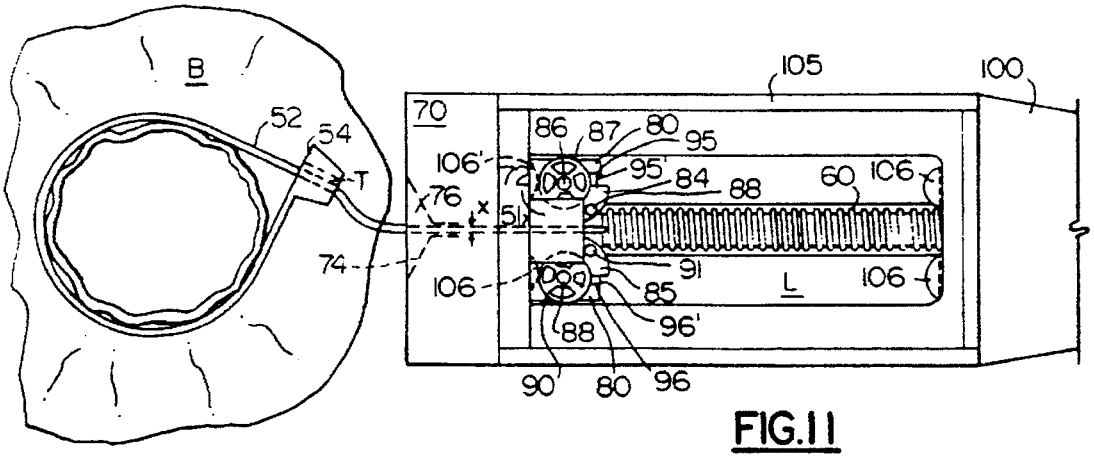
FIG. 11 is a plan view of the tensioning apparatus after receiving the tail-end of the bundling strap between the gripping jaws, where the bundling strap is inserted into the gripping means but not yet pulled tightly about the neck of a currency bag.
Figure 12:
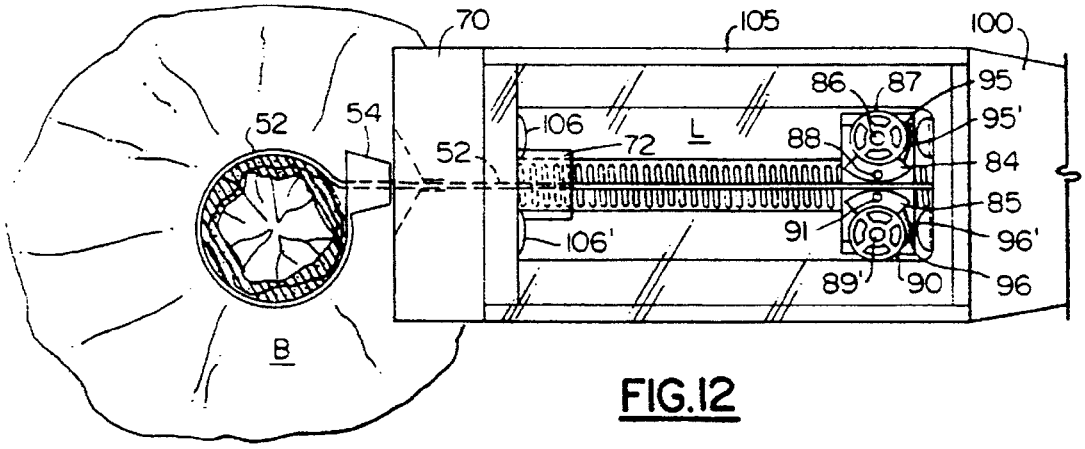
FIGS. 12 and 12A are plan views of the tensioning apparatus where the bundling strap has been pulled tightly about the neck of the currency bag.
Figure 12A:
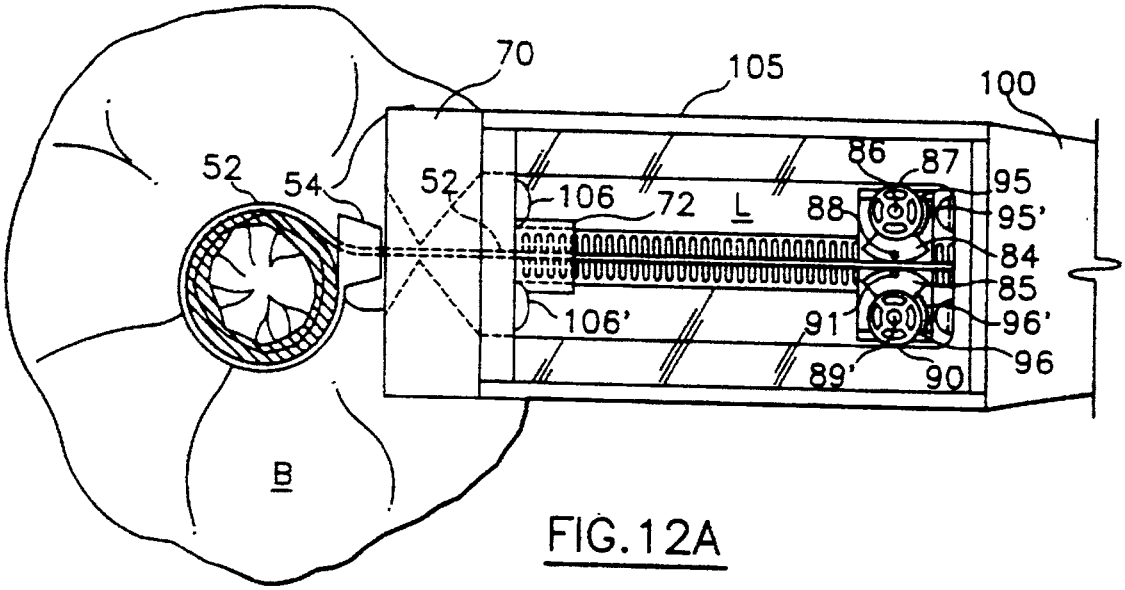

Housing 100 has cut out therefrom a generally Y-shaped channel L conforming generally to the elongate length of housing 100 and comprised of a lower floor portion 104, adjoining lower vertical walls 101, a pair of upper floors 103 and upper vertical walls 102. At the proximal and distal ends of said channel L may be positioned a pair of resilient damping members 106 and 106', respectfully. Surrounding said elongated channel L is a cylindrical safety collar member 105 adapted to fit snugly about the exterior of housing 100, the proximal end thereof adapted to engage a raised shoulder portion 105' of housing body 100 in abutting relationship. As seen in FIG. 8*a*, cylindrical safety collar 105 may be rotated to access the guide block 80. When the cylindrical safety collar 105 is rotated into the position shown in FIG. 8*a*, a recessed portion S5*c* of the collar allows a safety switch S5 (note FIG. 17) to remain closed, enabling power to the motor M1. The switch S5 includes an elongated actuation member attached to a plunger S5*a*. A resilient member S5*b* acts to push the plunger S5*a* into recessed portion S5*c*, closing the switch. When the safety cylindrical collar member 105 is further rotated into a position represented by S5*d*, this forces the plunger downward to place the switch S5 in its open position, disabling power to motor M1. In an alternative embodiment, switch S5 may be a proximity or hall switch which may be open or closed using the hall effect due to its proximity to a magnetized surface. The material would be placed within or onto cylindrical collar 105. Threaded screw or bolt openings 79' are disposed in the distal end of housing body 100. Housing body 100 has a bore 109 through its proximal end along the central axis thereof through which passes the proximal end of rod 60. Bore 109 is a blind drilled hole not passing completely through the housing body. The distal end of rod 60 adapted to ride in free spinning association within a bearing means 65. Bearing means 65 may be comprised of a pair of ball bearing race members 66 and 68 sandwiching a series of lubricated ball bearings enclosed within a disk shaped collar 67. Said bearing means 65 is centrally disposed within the proximal end of end cap means 70. End cap means 70 is removably connected to housing 100 by way of fastening means. Said fastening means are preferably comprised of a series of screws or bolts 79 disposed through openings 78 in end cap 70 for threading engagement with threaded openings 79' in housing body 100. In this way end cap means 70 is rigidly connectable to hand-held unit 54. When assembled, as shown in FIGS. 8 and 10, screws 79 are threaded into openings 79' in housing 100, which thereby sandwiches collar 105 between the proximal end of housing 100 and end cap 70. In this manner, the rod 60 and strap gripping means may be viewed readily. Disposed within end cap 70 is a seal follower 74 having an aperture 76 therein sized and shaped to correspond to the width and thickness dimensions of the body of a bundling strap 10, as best shown in FIGS. 11 and 12. Attached to the upper proximal end of end cap 70 is a rectangular plate or die opener 72 which is disposed generally directly above aperture 76. The end cap 70 has been constructed with a taper to allow buckling of the seal in the event a user does not release a sealed bag when the die members 84 and 85 reverse to release the seal. Said die opener 72 is designed to release the gripping means, to be discussed below, after the bundling strap tensioning operation is completed.

Slidably disposed within channel L of housing 100 is a means for gripping said bundling strap body 12 and for tensioning said bundling strap about the neck of a bank bag or other item(s) to be bundled. The gripping means is comprised, in the preferred embodiment, of a guide block 80 corresponding generally to the shape of channel L having disposed therethrough an internally threaded bore adapted to engage the threads of shaft 60 in mating association.

Guide block 80 has Associated therewith at its upper end a pair of spaced apart shear pins 86 and 89 adapted to act as rotating axes for a pair of partially rotatable die members 84 and 85, respectively. Said die members have a pair of opposed facing surfaces spaced apart a distance slightly greater than the thickness of strap body 12 measured in the direction indicated by the letter x shown in FIG. 11 when said die members 84 and 85 are in the open position shown in FIGS. 8 and 11. Die members 84 and 85 move in a die action manner so that their opposed strap gripping faces are slightly closer together when in the closed position shown in FIG. 12 than they are when in the open position shown in FIG. 11. In this way, said die members squeeze strap 12 when moved from their open toward their closed position.

Die members 84 and 85 have connected thereto a pair of die opener contact pins 88 and 91, respectively, adapted to contact die opener 72 after a tensioning operation is performed. Die members 84 and 85 each have disposed therein a bore through which are passed said shear pins 86 and 89, leaving said die members 84 and 85 free to rotate about shear pins 86 and 89, respectively. Die members 84 and 85 are free to rotate on shear pins 86 and 89, respectively, only to the extent allowed by surfaces 92 and 94 in one direction and surfaces 95 and 96 of guide block 80, as best shown in FIGS. 10 through 12. In this manner, during the tensioning operation that occurs between FIGS. 11 and 12, die members 84 and 85, respectively, are rotated by virtue of the frictional interconnection between said die member and the strap body 12 until they abut surfaces 92 and 94, respectively. Conversely, after the tensioning operation is carried out, the direction of rotation of rod 60 is reversed, causing guide block 80 to traverse from the proximal end to the distal end of said rod 60. Once die opener contact pins 88 and 91 are brought into contact with die opener 72, die members 84 and 85 are forced to rotate in the opposite direction from that above identified, thereby relieving the frictional interconnection between said die members 84 and 85 and strap body 10. Surfaces 95 and 96 are employed, therefore, to limit the amount of rotation of die members 84 and 85 brought about by die opener 72.

A pair of springs 95' and 96' are connected to dies 84 and 85 which act on guide block 80 at surfaces 95 and 96 to maintain die members 84 and 85 in a predetermined, partly closed, position so that they may receive a new strap 12 prior to each tensioning operation without binding. Said springs assure that die members 84 and 85 will receive the new strap body 12 under equal force conditions so that each said die member will exert equal frictional and compressive forces on strap body 12 through successive iterations of the method described herein. Retaining rings 87 and 90 may be employed to fix die members 84 and 85 in rotatable association with guide block 80, as best seen in FIGS. 9, 10 and 11. In yet another embodiment, interchangeable springs 57 are replaced with a die link 57*a*, which joins a gripping means comprised of die gripping surfaces 84, 85. The die link 57*a* includes apertures 57*d* and 57*e*, which are disposed to accept shear pins 86, 89 and die opener contact pins 88 and 91, respectively. A retaining spring 57*b* provides a resilient force to constrain the die surfaces 84, 85 simultaneously towards one another. Therefore, die link 57*a*, rigidly attached to retaining spring 57*b* provides the same function as the interchangeable springs without the added complexity of additional mechanical components.

Control unit 120 is electrically connected to hand-held unit 54 by a conductor carrying cable 58. A pin connection means 122 is preferably employed to electrically connect cable 58 with the electronic circuitry within control unit 120 and with unit 54. However, other suitable electrical connecting means may be employed such as direct wiring, ribbon cable connection, or other appropriate means of connection.

Generally, with respect to the guide block 80, the sealing process is comprised of movement from its position shown in FIG. 11 to its position shown in FIG. 12 and then back again to its position shown in FIG. 11. It is preferred that the operator apply a modest withdrawal force on strap 12 while guide block 80 moves from its position shown in FIG. 12 back to its position shown in FIG. 11 so as to avoid any binding of strap 12 within channel L.

The speed of rotation of shaft 60 and hence of guide block 80 in moving from left to right in FIG. 11 during the beginning of the sealing operation is adjustable by way of adjustable resistor 132. In this manner, the seal tension may be increased or decreased by increasing or decreasing the output voltage applied to the motor M1. Thus, the point in which the movement of guide block 80 changes can be adjusted by adjusting resistor 132. The approximate operating voltage is, in the preferred embodiment, 24 volts DC causing output shaft 56 to rotate at approximately 1600 RPM.

It should be noted that the reverse mode kick-back timer adjustment means 130 is preferred so as to overcome the instantaneous start-up torque in the reverse direction immediately following the pre-set maximum tension in strap 12 having been reached. In everyday use, an automatic seal machine of the nature disclosed herein may be called upon for substantially constant operation. Therefore, controller logic the same as or similar to that disclosed herein is preferred so that the effect of variations in performance such as bank bag size, strap 12 thickness and strength, and temperature.

Indicia means for identification such as raised markings 99 may be associated with die members 84 or 85 for imprinting identifying indicia on strap 12, as, for example, a code or name of a financial institution. Said indicia means is preferably unique for each additional machine 50. Further, indicia means (not shown) may be used in association with member 74 which would imprint a code or name on or about head 14 as well. In this manner, indicia means I appears on both strap body 12 and head 14 when enclosing a flexible closure B so that if one managed to dislodge strap 10 and gain access to the contents of closure B, strap 10 is destroyed by virtue of its brittle constitution and a new strap cannot be imprinted with the identical indicia as appeared originally unless the thief had access to the seal machine originally used, which is unlikely.

Preferably, at least one detent 25 should be provided in strap body 12 for the purpose of intentionally creating a stress raiser which will rupture upon the imposition of a predetermined tampering force. The broken strap will provide an indication of tampering. The detent may be disposed either at an oblique angle relative to the elongate centerline of strap 10 or normal thereto depending upon the degree of sensitivity to tampering desired. The yield strength of the strap at detents 25 should be slightly lower than the yield strength of the locking means so that the strap 10 will break apart at the detent 25 rather than the strap body 12 pulling out of head 14 should the strap be tampered with by sufficient force. The cross-sectional configuration of the detent 25 may be, preferably, triangular, or may also be semi-circular, rectangular, or any other shape which most effectively produces the desired yield limit.

The improved closure strap of the instant invention is preferably comprised of a single piece of an acetal homopolymer such as Delrin or Delrin II. However, the strap 10 may be comprised of any material exhibiting the physical properties required of the instant invention, namely, that of flexibility, very low degree of malleability, brittleness under compression and mechanical homogeneity to ensure predictable behavior under a wide range of applications and conditions.

Figure 7:
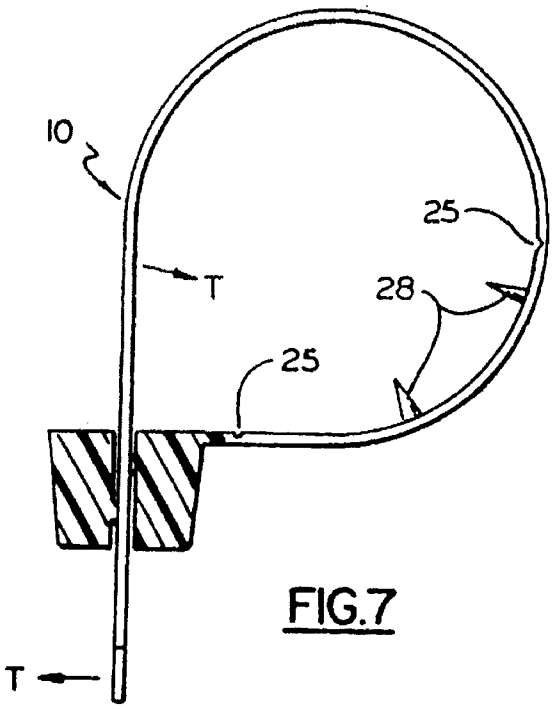
FIG. 7 is an elevational partial cutaway view of the bundling strap of FIG. 1 shown looped upon itself with the body portion thereof passed through the aperture defined by the head-end portion.

As best seen in FIG. 2, the projecting teeth members 34 are raised somewhat in the vertical direction relative to projecting teeth members 36 in head-end portion 14. Because of the inherent resiliency of the material used to manufacture strap 10, there is a built-in tendency for the strap body portion 12 to twist in the direction of arrows T—T of FIG. 7. This twisting causes the trailing edges 26 of serrations 22 to contact more firmly the surfaces 34' and 36' of teeth members 34 and 36, respectively. Further, it is preferred that said teeth members 34 and 36 be staggered in height relative to each other so as to allow sufficient space within aperture 30 through which body portion 12 may pass on insertion of body 12 into head-end 14. Teeth are staggered to also resist tampering by creating a wedge configuration between the serrations 12 and teeth 34 and 36. In an alternative embodiment, teeth 34 and 36 may not be staggered and may be directly opposite one another in position.

In the preferred embodiment, as seen throughout the figures, head-end 14 is tapered from top to bottom on all four sides so that if compressive forces are applied to the head-end 14 by, for example, a pair of pliers, in an attempt to force teeth members 34 and 36 out of engagement with serrations 22, the compressive forces will be more likely concentrated at a single point on either side of head 14 rather than over a substantial surface area thereof, giving rise to the increased likelihood that the head will shatter and thereby indicate tampering. Head 14 may, however, be configured in alternative shapes including that of a three-dimensional rectangle or cube.

Figure 1:
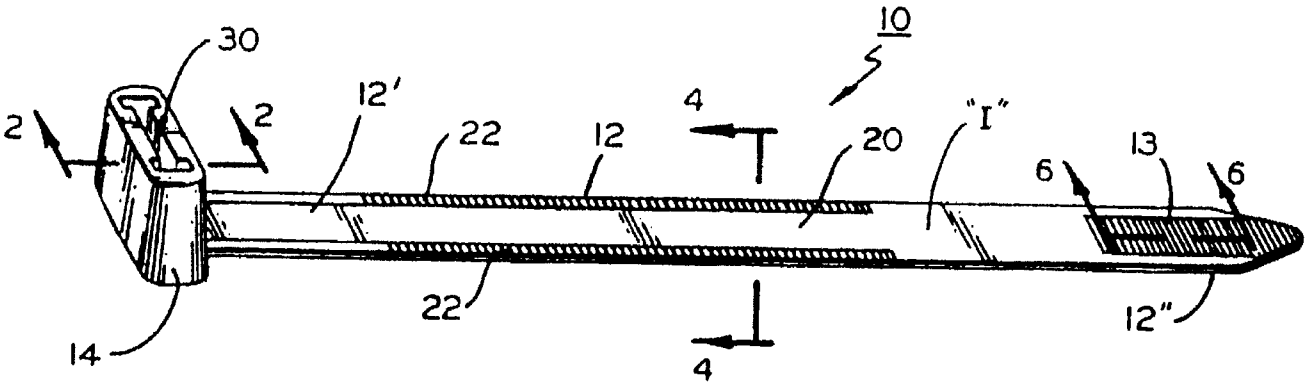
FIG. 1 is a perspective view showing the novel tamper-proof bundling strap of the instant invention.
Figure 4:
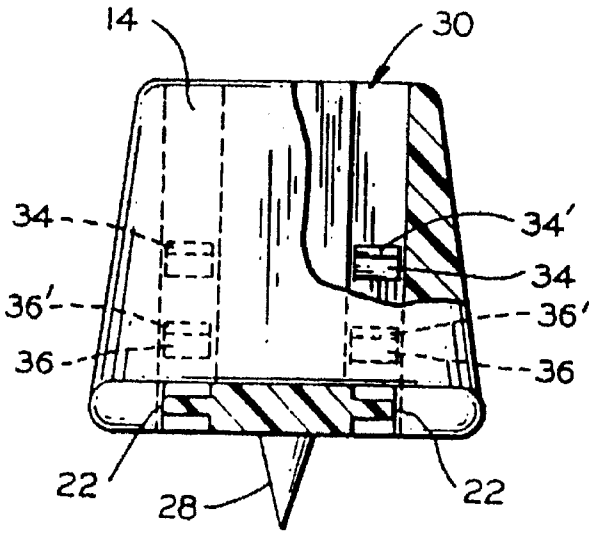
FIG. 4 is a cross-sectional view of the invention taken along lines 4—4 of FIG. 1.
Figure 3:
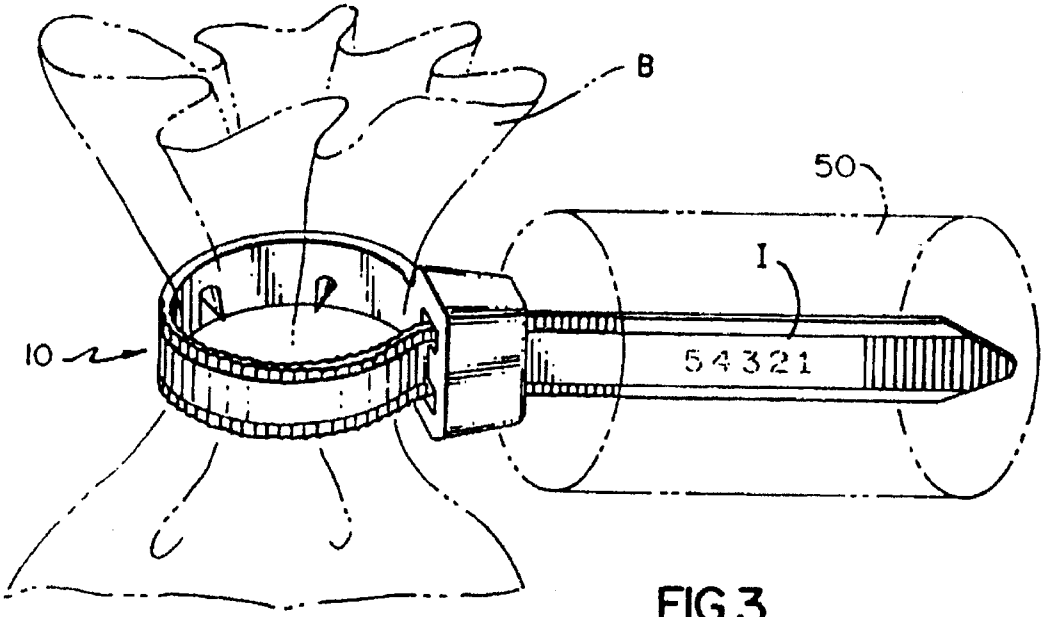
FIG. 3 is a perspective view showing the strap in use about the neck of a flexible container being bundled in association with a tensioning machine therefore.

In the preferred embodiment shown in FIGS. 1 and 3, when the strap 10 is used with the automatic strap tensioning device 50 referred to earlier and shown in FIGS. 8–15, the serrations 22 are absent from the initial length of strap body 12comprised by end segment 12" and grooves 15 alongside and indicia marking area I so as to provide a sufficient length of strap 10 which can be fed through the head end 14 and gripping jaws 84 and 85 of unit 50 before serrations 22 come into contact with teeth 34 and 36. Grooves 15 allow clearance for strap body 12 to pass between teeth 34 and 36 prior to commencement of the automatic tensioning steps of the method of tensioning of this invention. All of the foregoing permits easier insertion of the strap body 12 into head-end portion 14 to facilitate the efficient and, if desired, rapid application of the strap 10 about items to be bundled or flexible closure B to be sealed.

It should be noted that indicia marking area "T" may be smooth textured or otherwise treated as required to more effectively receive indicia thereon.

It is preferred that at least one sharp piercing means or projection 28 be connected to the underside of body portion 12 when the strap of the instant invention is used in connection with a flexible closure such as a bank bag B, said projection 28 acting to restrain strap 10 from relative movement therewith when pulled taut about the neck of bag B. It can therefore be seen in FIGS. 3 and 7 that projection(s) 28 face inwardly toward the object to be bundled B when the body portion 12 is bent backwardly against itself and passed through aperture 30 in head-end 14.

The instant invention also comprises a method for drawing a bundling strap 10 taut about the neck of a flexible container such as a bank bag B, comprised of the steps of:

looping bundling strap 10 about the open neck of a flexible container B;

inserting the tail end 12" of the strap 10 through an aperture 30 defined in the head-end portion 14 of the strap 10;

pulling said tail-end of said strap completely through said aperture 30 until at least the first set of serrations 22 disposed along opposed side edges of the strap body 12 are engaged by teeth members 34 and 36 projecting upwardly into the interior of the aperture 30, thereby locking the strap body 12 against reverse movement relative to said head-end portion 14;

inserting the tail-end portion 12" of the strap between a pair of strap body gripping jaws 84 and 85 which are disposed for reciprocal movement within an automatic bundling strap tensioning apparatus 50, said gripping jaws adapted to move linearly between an extended position and a retracted position;

causing said gripping jaws 84 and 85 to move from the extended to the retracted position, thereby pulling the strap body 12 through said aperture 30 and closing the neck of the flexible container;

causing said gripping jaws 84 and 85 to move from the retracted toward the extended position to release the strap body 12 from engagement between said gripping jaws.

A further step may be added to the above recited method of imprinting the strap body with indicia using indicia printing means associated with said gripping jaws 84, 85 adapted to imprint indicia upon the strap body, preferably at indicia receiving area "T" located on the strap body.

Figure 13:
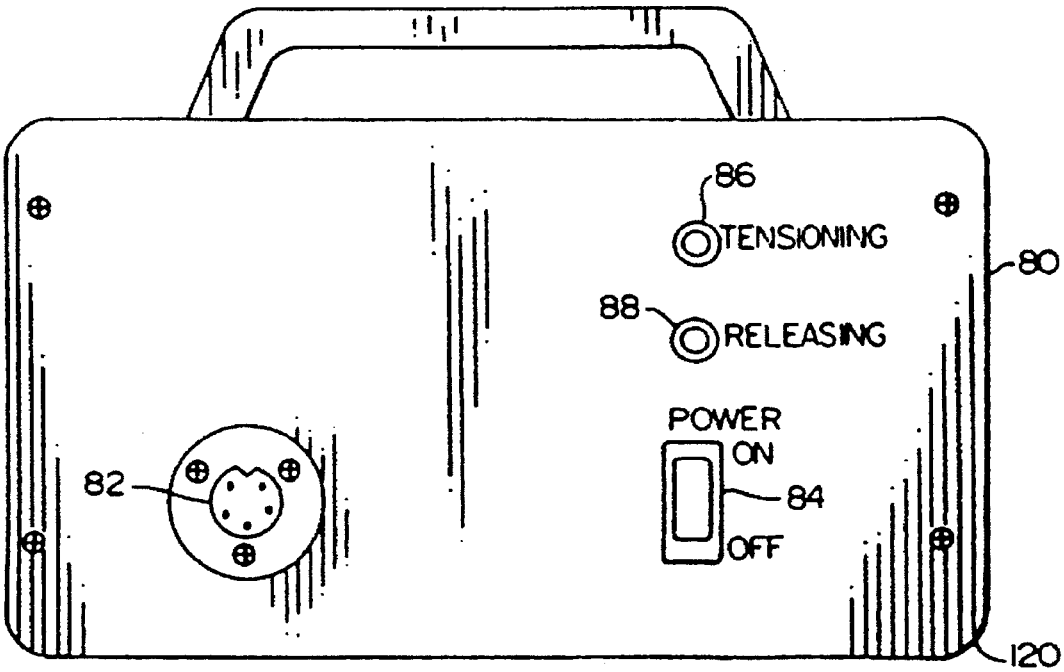
FIG. 13 is a front elevational view of a housing for a power and direction control means.
Figure 14:
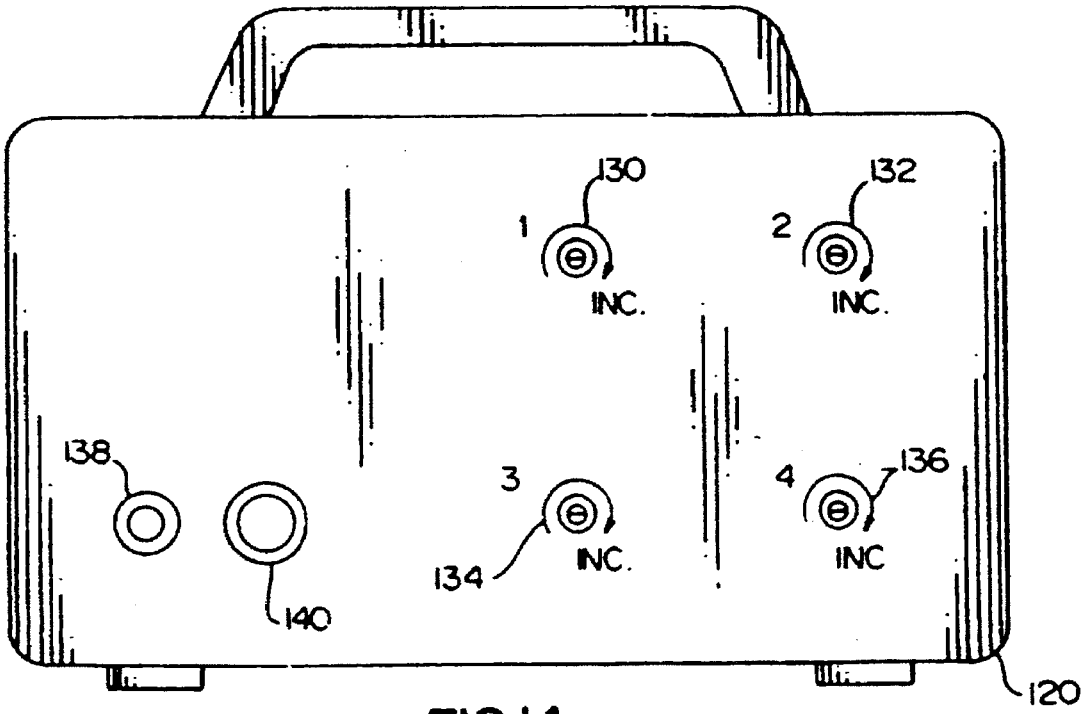
FIG. 14 is a rear elevational view of said housing.
Figure 15:
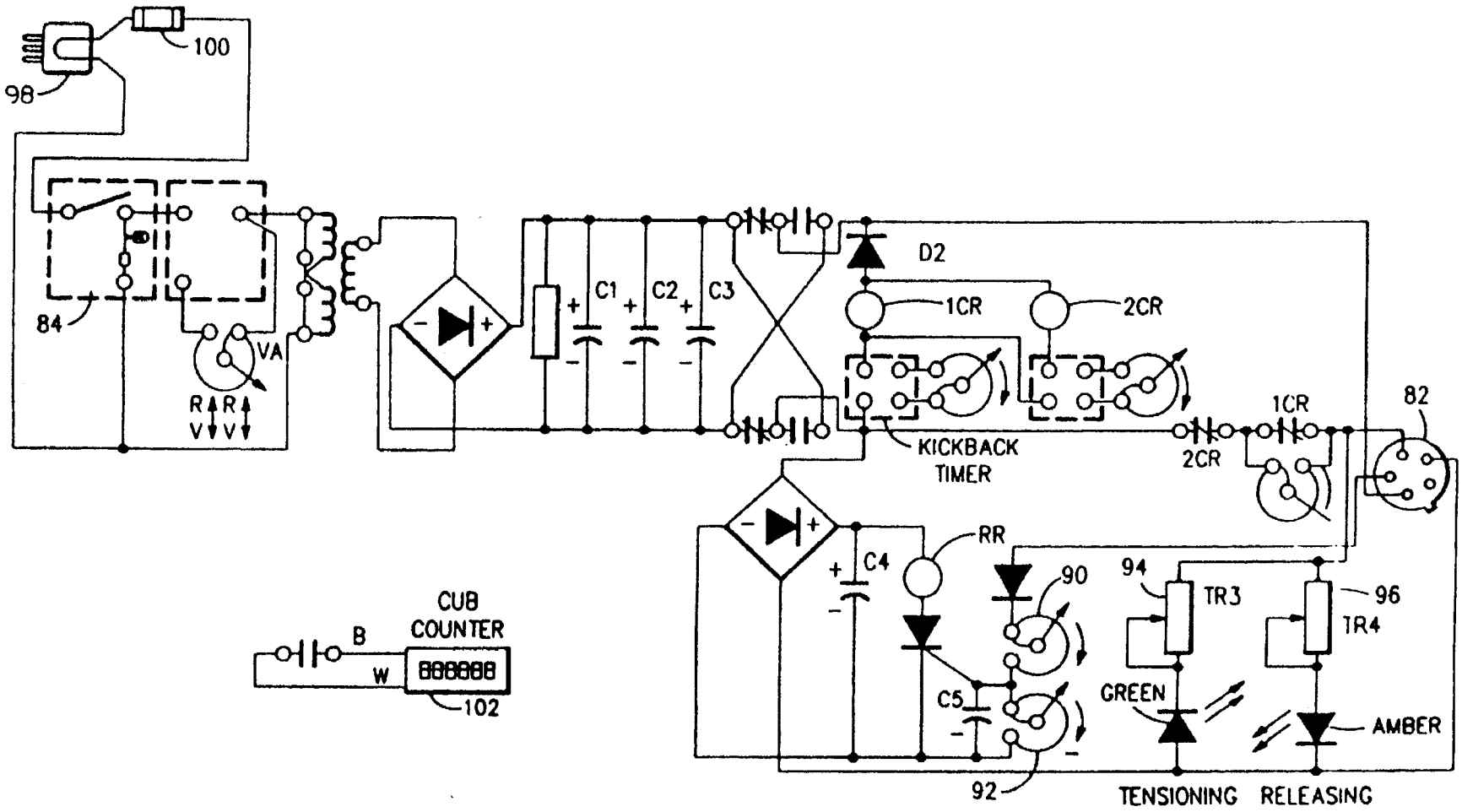
FIG. 15 is a schematic diagram of the power and direction control means.

As best shown in FIGS. 13 through 15, control unit 120 is provided with an on/off switch 84, tensioning operation indicator light 126 and releasing operation indicator light 128. Power from a remote source such as a wall outlet is provided through opening 138 on the reverse side thereof, shown in FIG. 14. Protection against power surges or other electrical malaise may be provided in the form of a fuse or fuseable link 140. Means for adjusting the operational characteristics of the strap tensioning device 50 are provided by variable timers 130 and 134 and variable resistors 132 and 136. A digital display (not shown) may be provided to indicate the tensile force exerted by the gripping means on the strap 12. Tensile forces generated in strap 12 are dependent upon and are a function of the adjustment of adjusting means 132 and 136.

Timer 130 may be referred to as a reverse mode kick-back timer which causes a delay between the time the motor M1 is disabled and the time it is re-enabled, as when the direction of rod 60 is reversed. Such a reversal occurs when it is desired to change the direction of movement of guide block 80. For example, as shown in FIG. 11, to begin the tensioning operation, strap body 12 is placed between die members 84 and 85, at which time guide block 80 is at the distal end of rod 60. Thereafter the motor M1 is energized by the circuit of FIG. 8 causing rod 60 to rotate in the counter-clockwise direction when viewed from the distal end of rod 60, thereby causing guide block means to move from the left to the right of FIG. 11. This movement simultaneously causes die members 84 and 85 to rotate into abutting engagement with surfaces 92 and 94, respectively, thereby frictionally engaging strap body 12 and pulling it along at the same speed and in the same direction of travel as guide block 80. Continued movement of guide block 80, and hence die members 84 and 85, pulls strap 12 into tight bundling position about the neck of currency bag B.

Upon a predetermined load being exerted by strap 12 on die members 84 and 85, and hence guide block 80, which load is also thereby exerted against the rotation of rod 60, motor M1 is disabled by the circuit shown in FIG. 15 and instantaneously re-energized in the opposite direction, thereby causing shaft 60 to rotate in the clockwise direction when viewed from its distal end. This will cause guide block 80 to travel from right to left in FIGS. 11 and 12 until die opener 72 contacts die opener contact pins 88 and 91, causing die members 84 and 85 to come into abutting contact with surfaces 95 and 96, respectively. When this occurs, the load exerted by guide block 80 on rod 60 causes motor M1 to be reversed by the circuit of FIG. 15 according to the adjustment of variable resistor 136. If the predetermined load required to disable the motor M1 is not reached, an adjustable reverse mode maximum cycle timer 134 will cause the motor M1 to be disabled after a predetermined, brief, time to avoid burning out the motor M1 if the operator were to maintain power to the hand-held unit after the sealing process was completed.

FIGS. **16–20*f*** illustrate an alternative embodiment of the present invention, showing the hand-held unit connections and main power connections as well as the associated system and circuity used to operate the unit at desired user-selected parameters.

Figure 16:
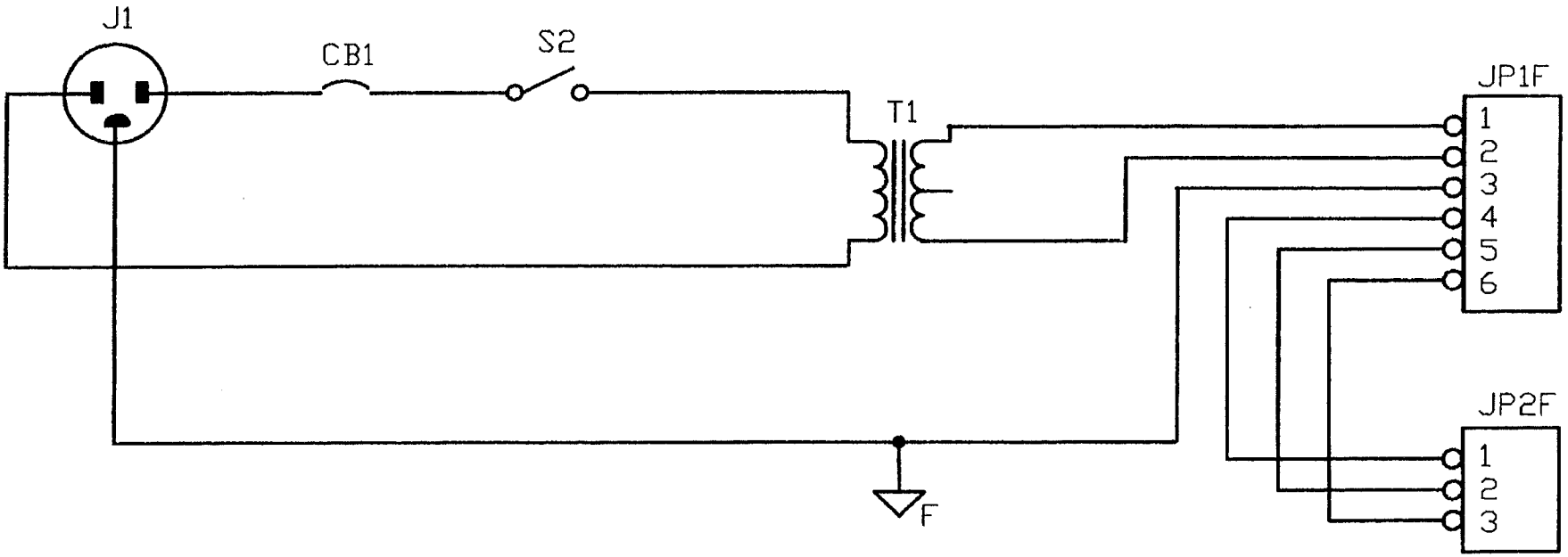
FIG. 16 is a schematic diagram of the main power circuits shown in FIGS. 19*a*–19*i* and 20*a*–20*f*.

FIG. 16 shows the main power connections used to communicate power to the CPU board shown in FIGS. **19*a*–19*i* and the analog board shown in FIGS. 20*a*–20*f*. A step-down transformer T1 is associated with an AC power plug J1, fuse CB1 and on/off key switch S2. The secondary of transformer T1 is attached to ribbon connectors JP1F and JP2F. Connector JP1F communicates with the CPU board head connector JP2M (FIGS. 19*a*–19*i*) while connector JP2F communicates with the analog circuit board at connector JP1M (FIGS. 20*a*–20*f***).

Figure 17:
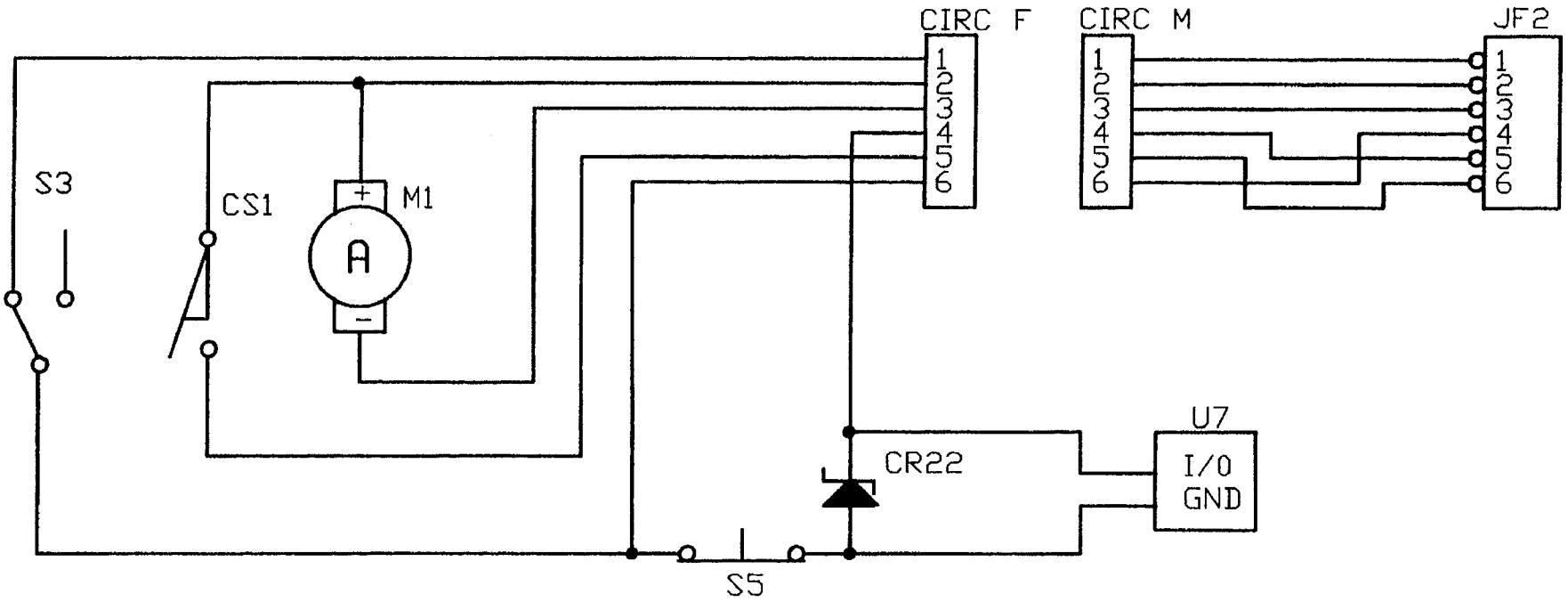
FIG. 17 is a schematic diagram of the hand-held unit connections to the circuit shown in FIG. 20*a*–20*f*.

FIG. 17 shows the connection of the hand-held unit 54 to the analog circuit shown in FIGS. 20*a*–20*f*. The hand-held unit includes motor M1, a clutch switch CS1, as well as the trigger switch S3. Trigger switch S3 is shown closed in a depressed position. A push button switch S5 activates a zener diode CR22 and a 48 bit serial number integrated circuit U7 which will be further described hereinafter with regard to FIGS. 20*a*–20*f*. The handheld unit and associated components are connected to the operational circuitry as shown in FIGS. 19*a*–*i* and 20*a*–*f* through a connector CIRC F attached to the hand-held unit housing. A six conductor cable (not shown) extends between female connector CIRC F and a similar female connector CIRC M which is mounted to the surface of the housing containing the operational the circuitry shown in FIGS. 18–20*f*. Similarly, a circuit board connector J2F is used to attach connections from the circuit board connector CIRC M to the internal CPU and analog circuit boards.

Figure 18:
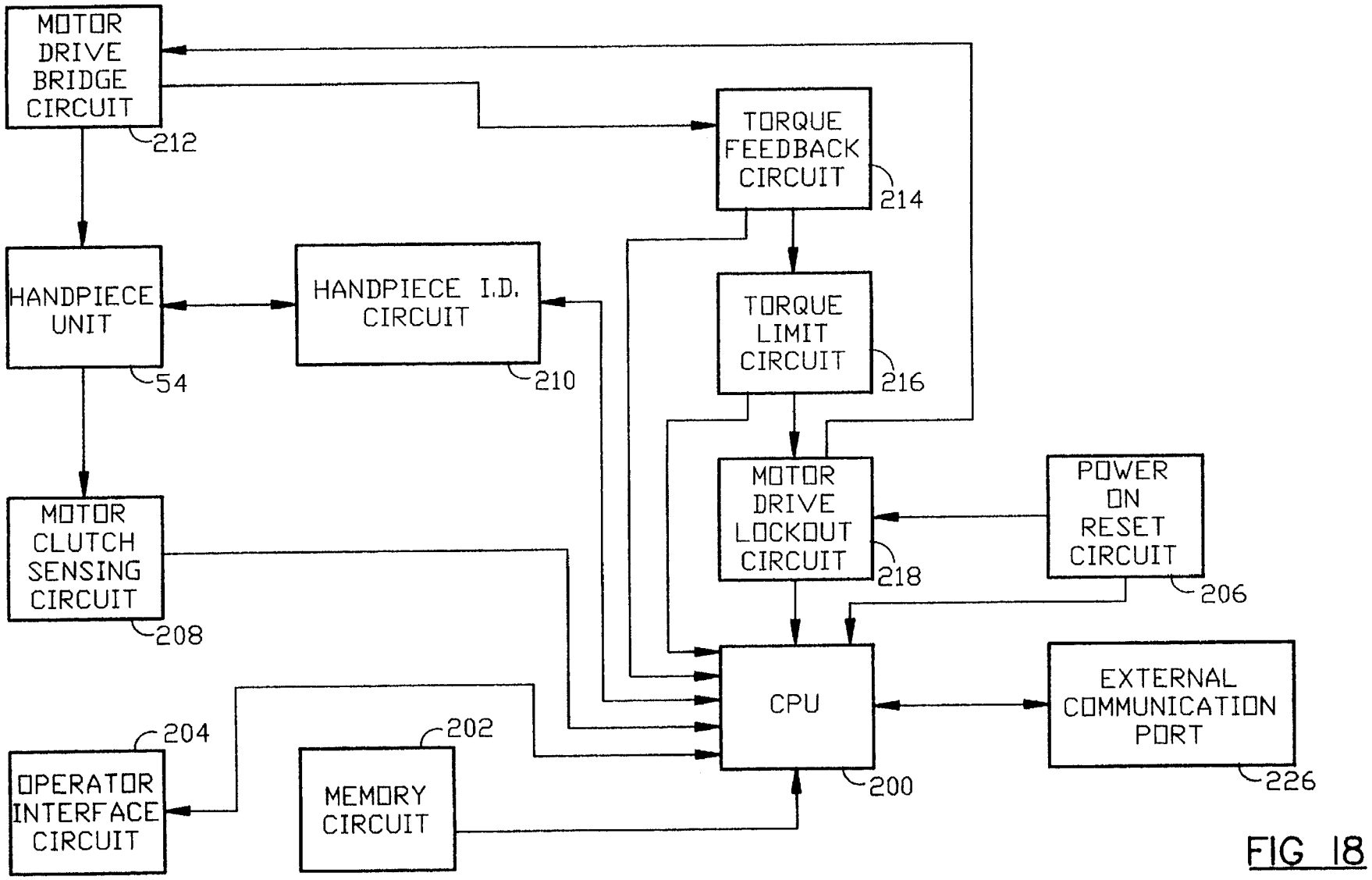
FIG. 18 is a block diagram showing the connections between the CPU board and analog board shown in FIGS. 19*a*–19*i* and 20*a*–20*f*, respectively.
Figure 19A:
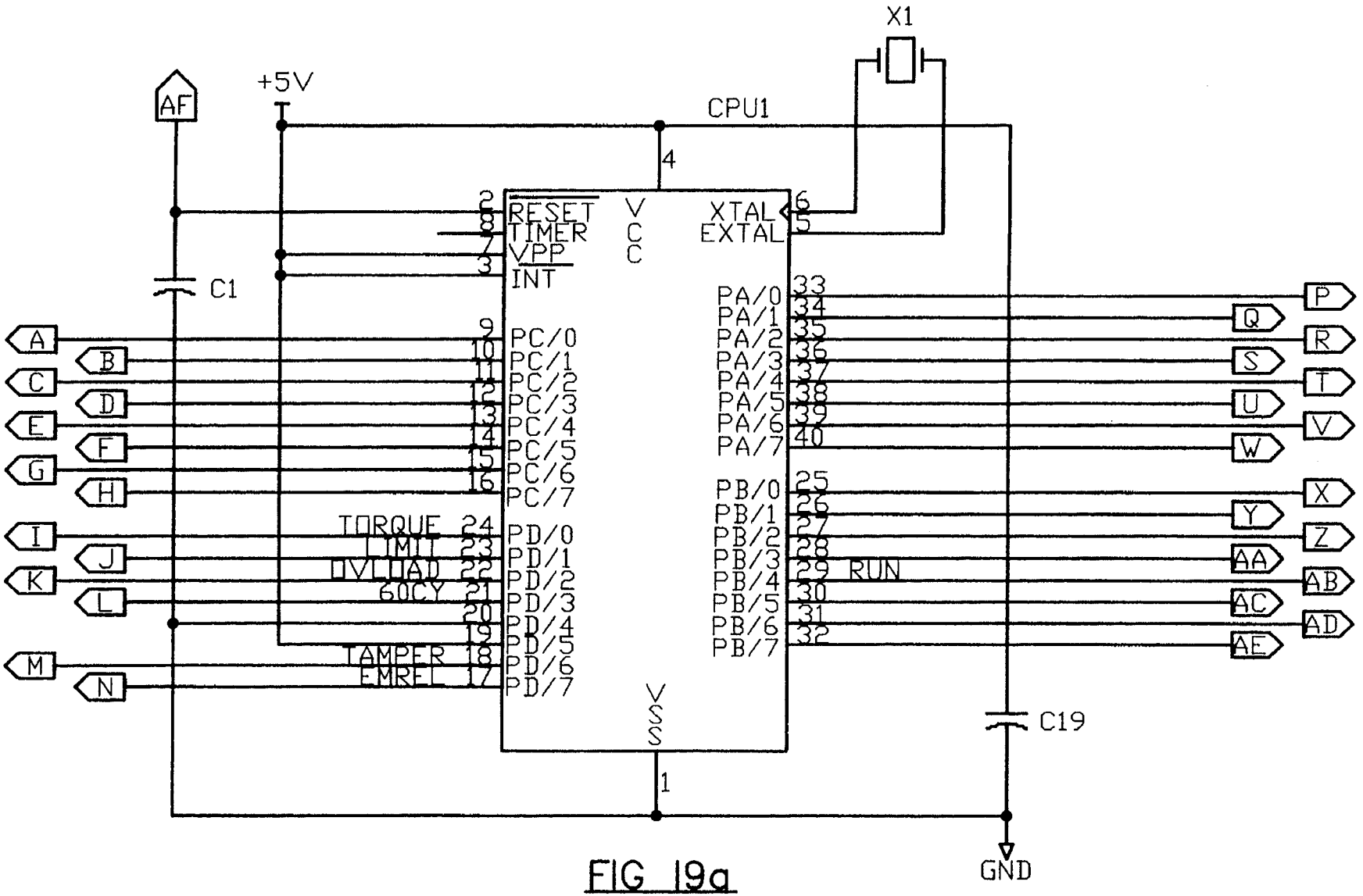
Figure 19B:
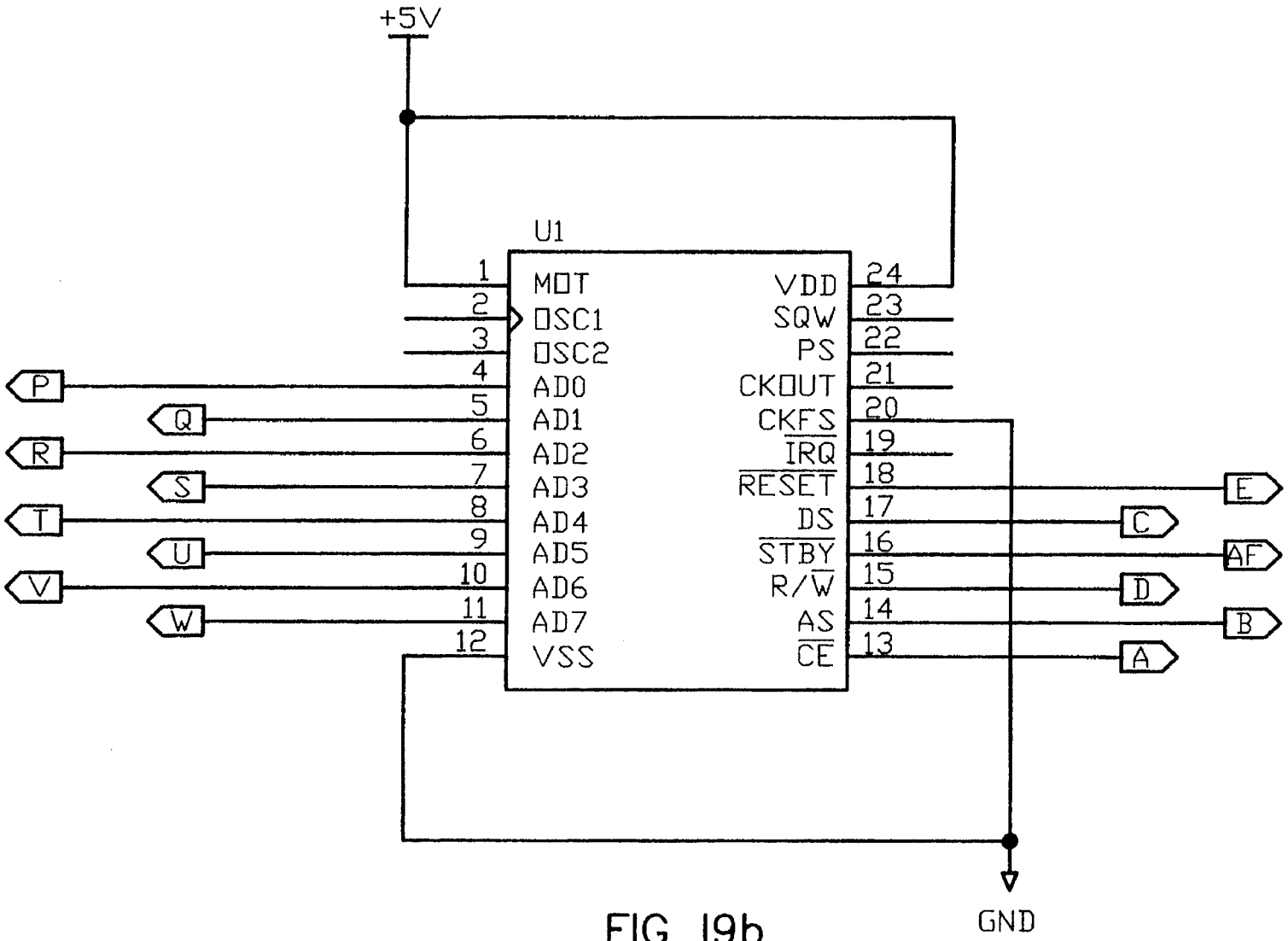
Figure 19C:
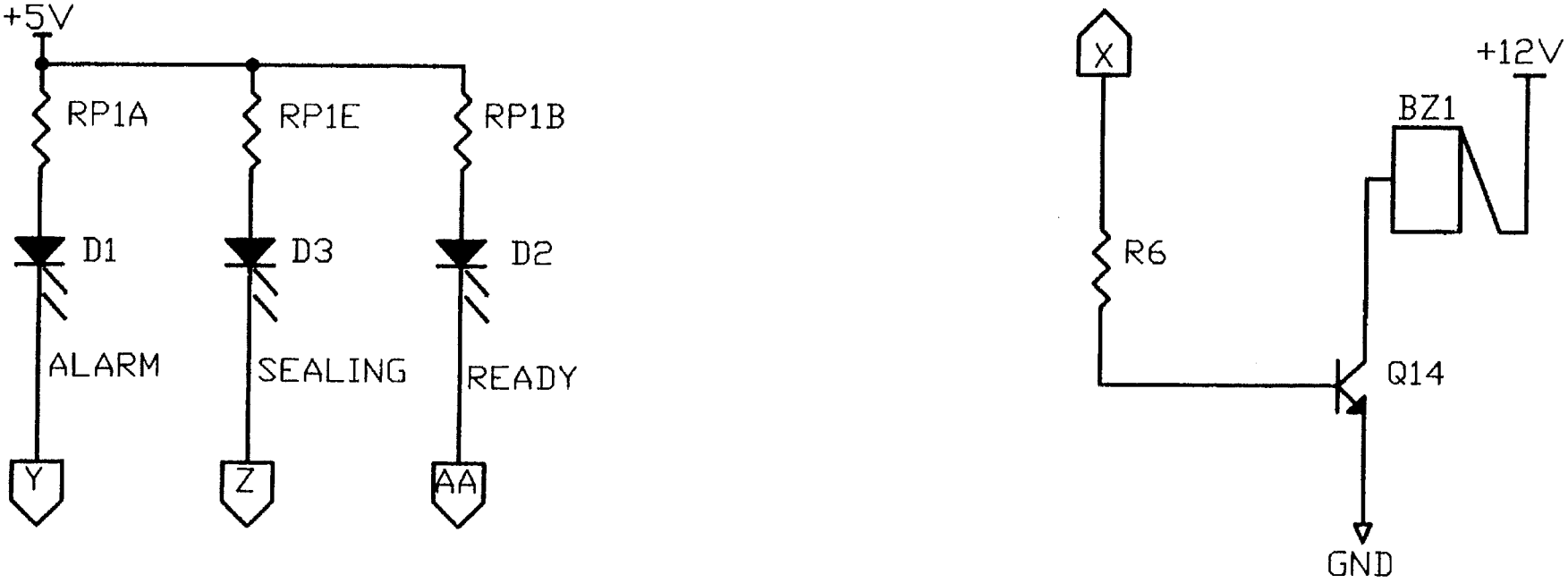
Figure 19D:
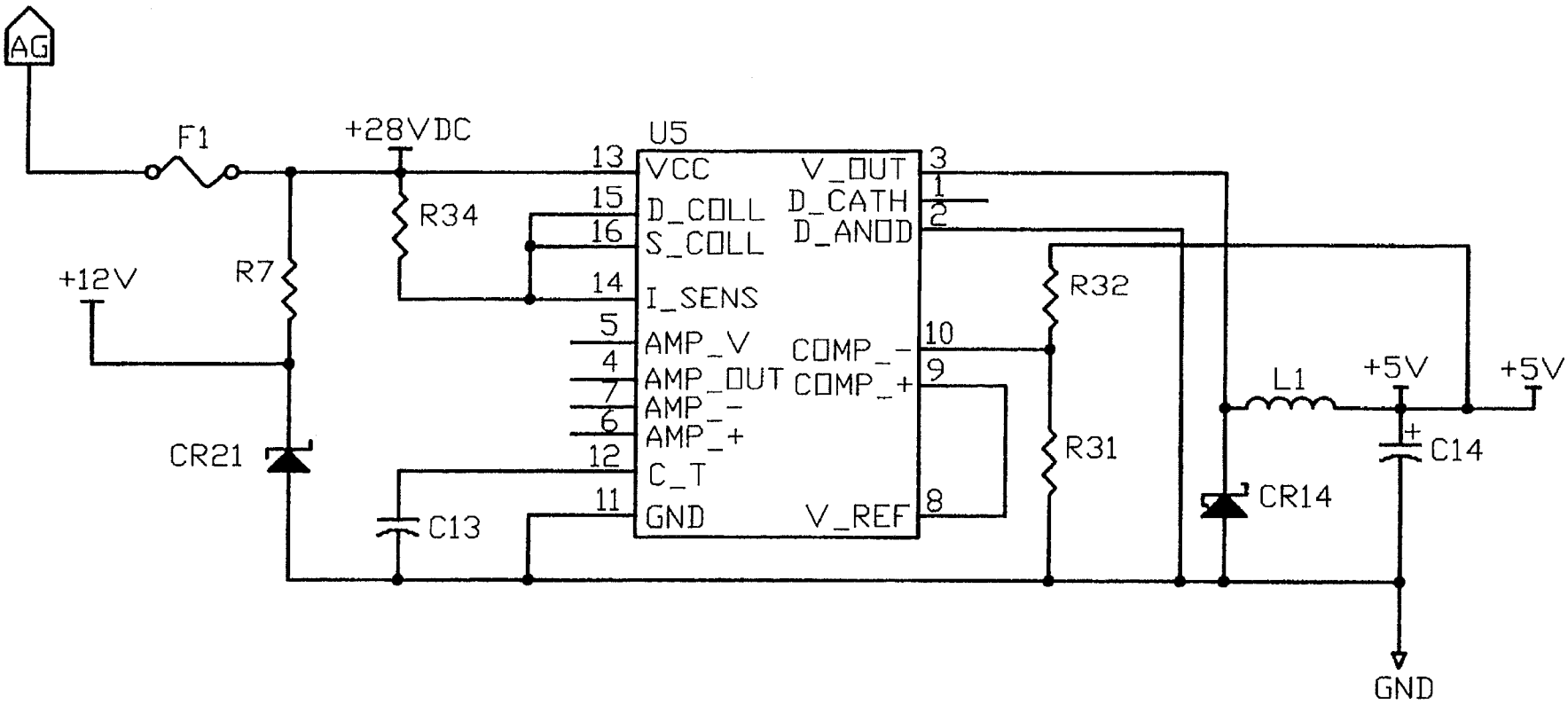
Figure 19E:
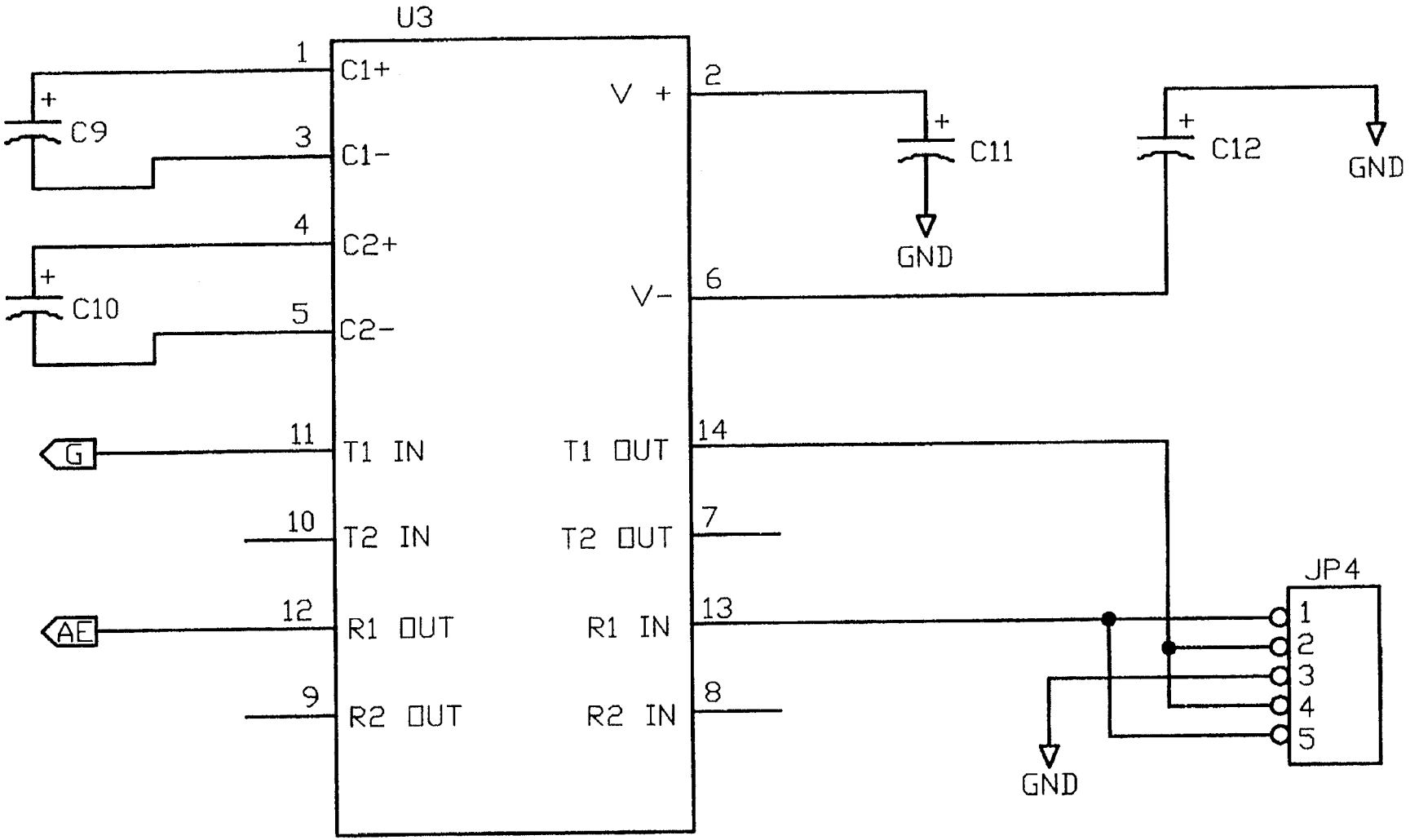
Figure 19F:
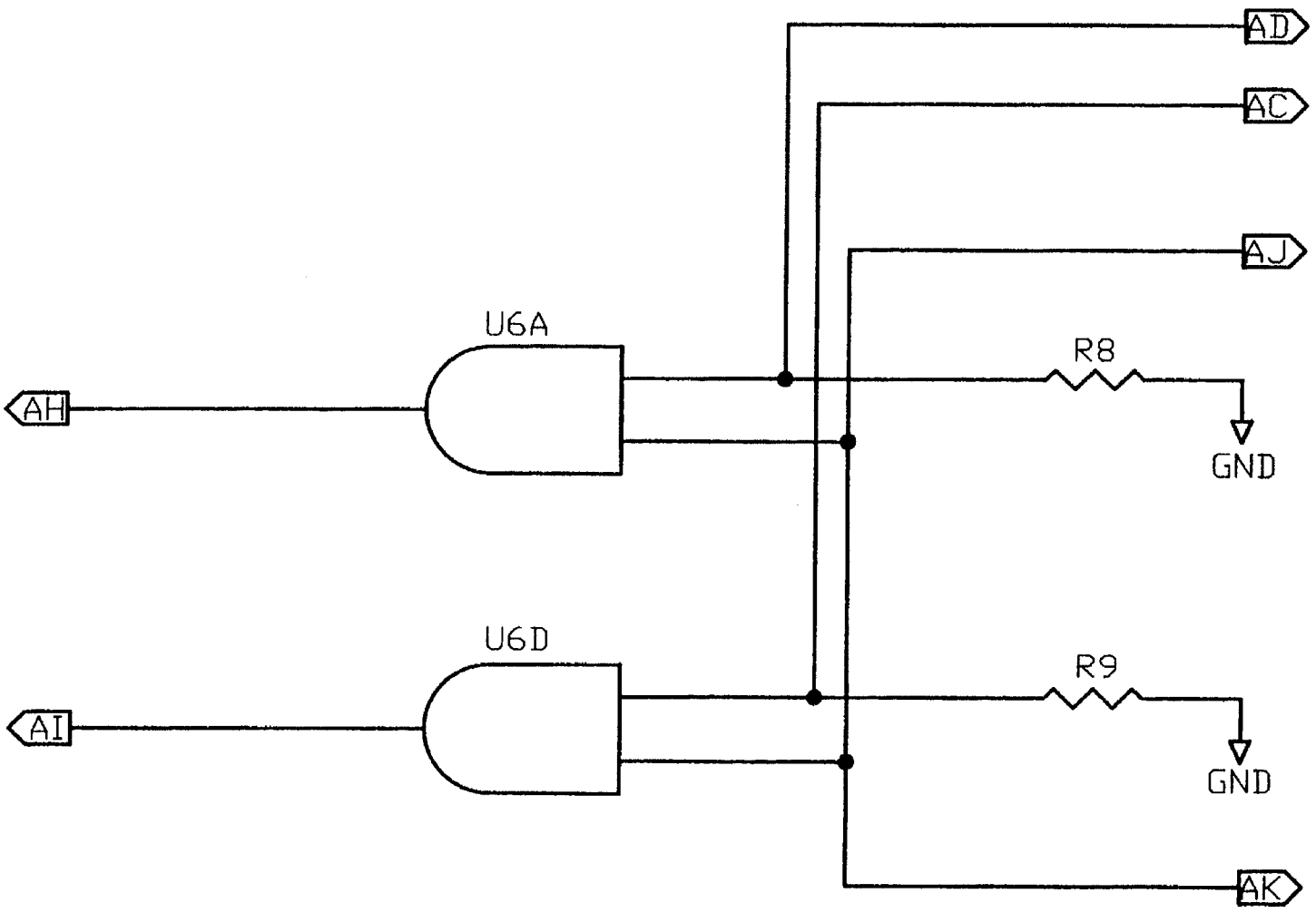
Figure 19H:
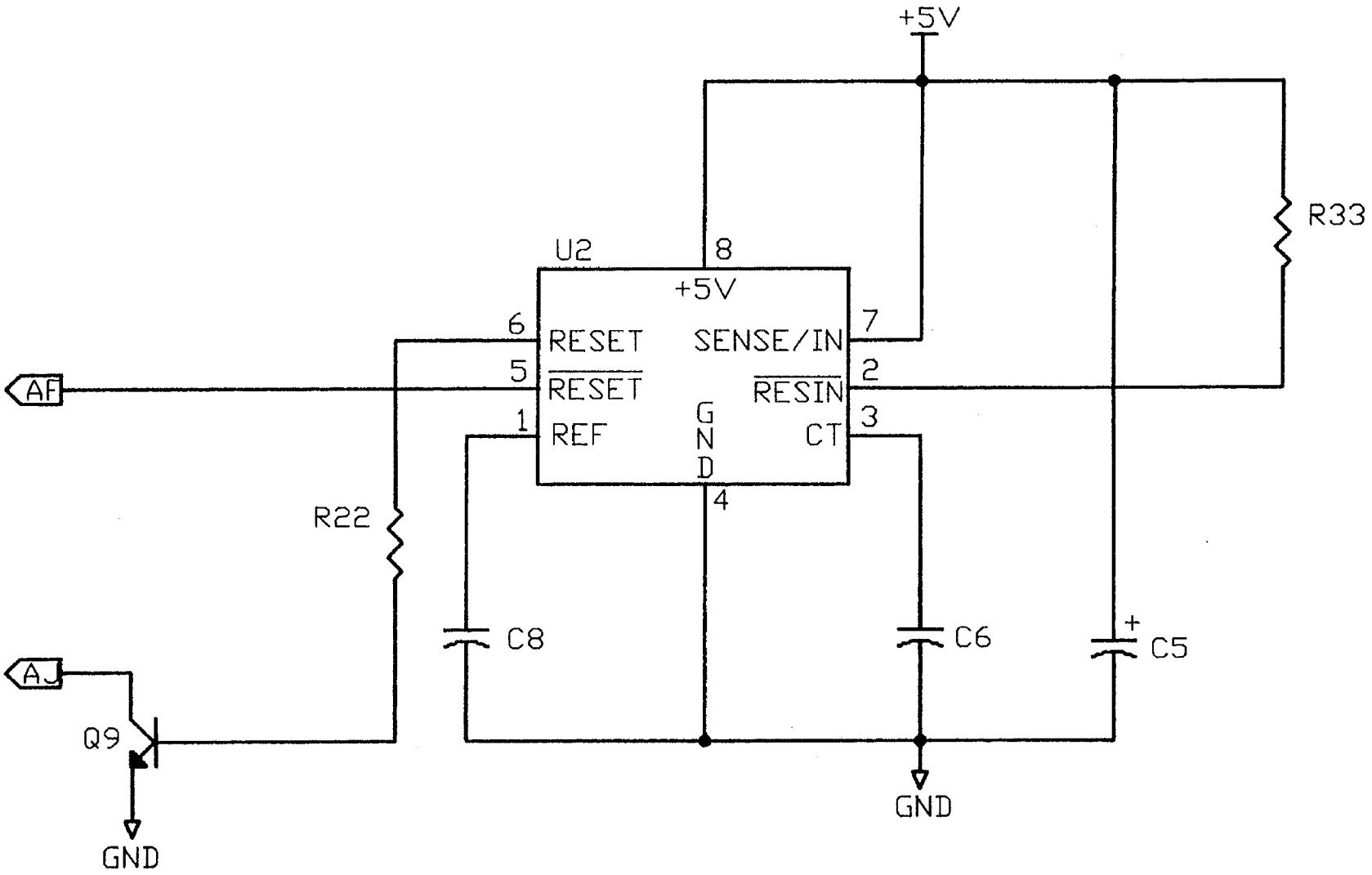
Figure 19I:
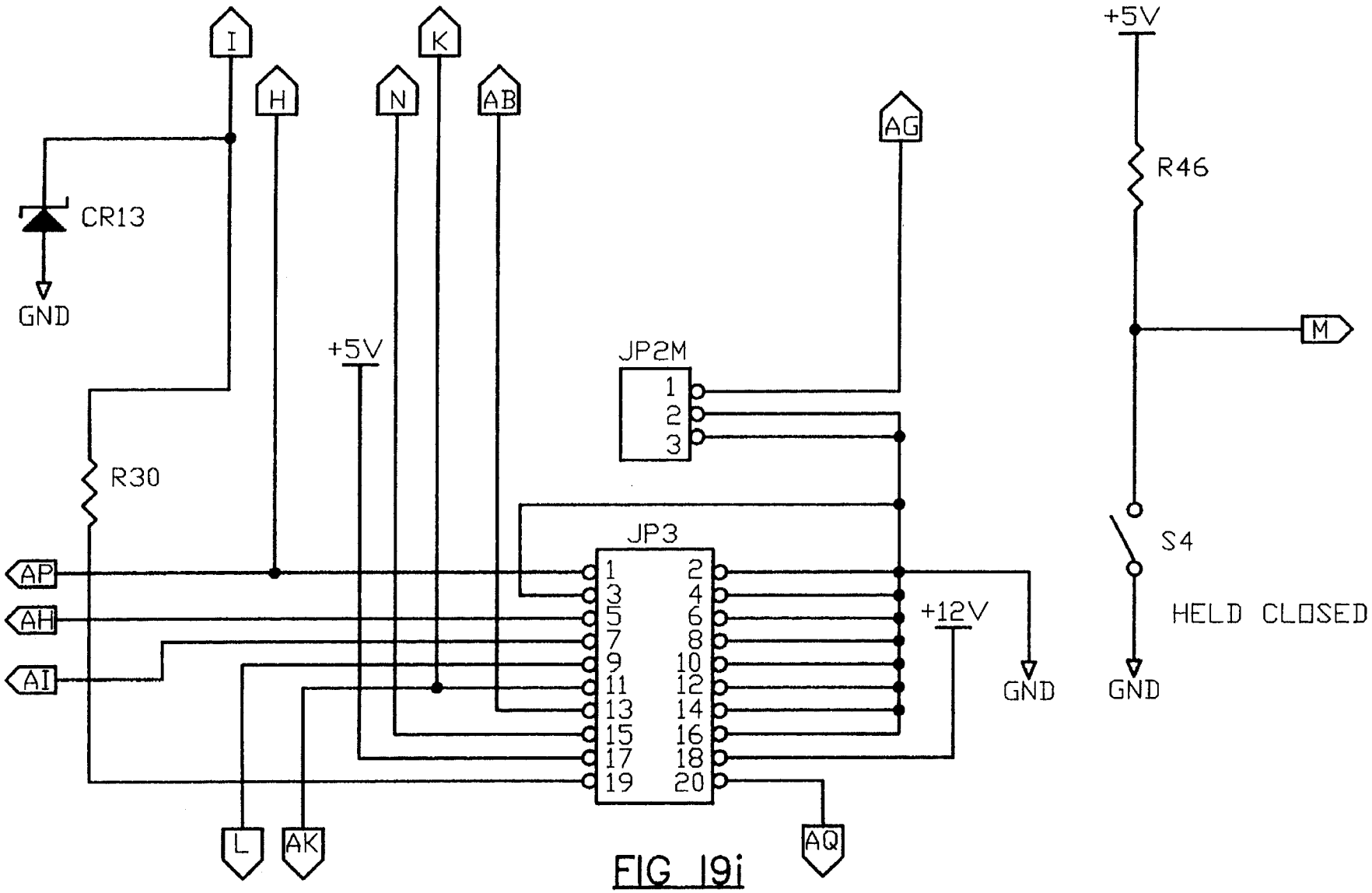
Figure 20A:
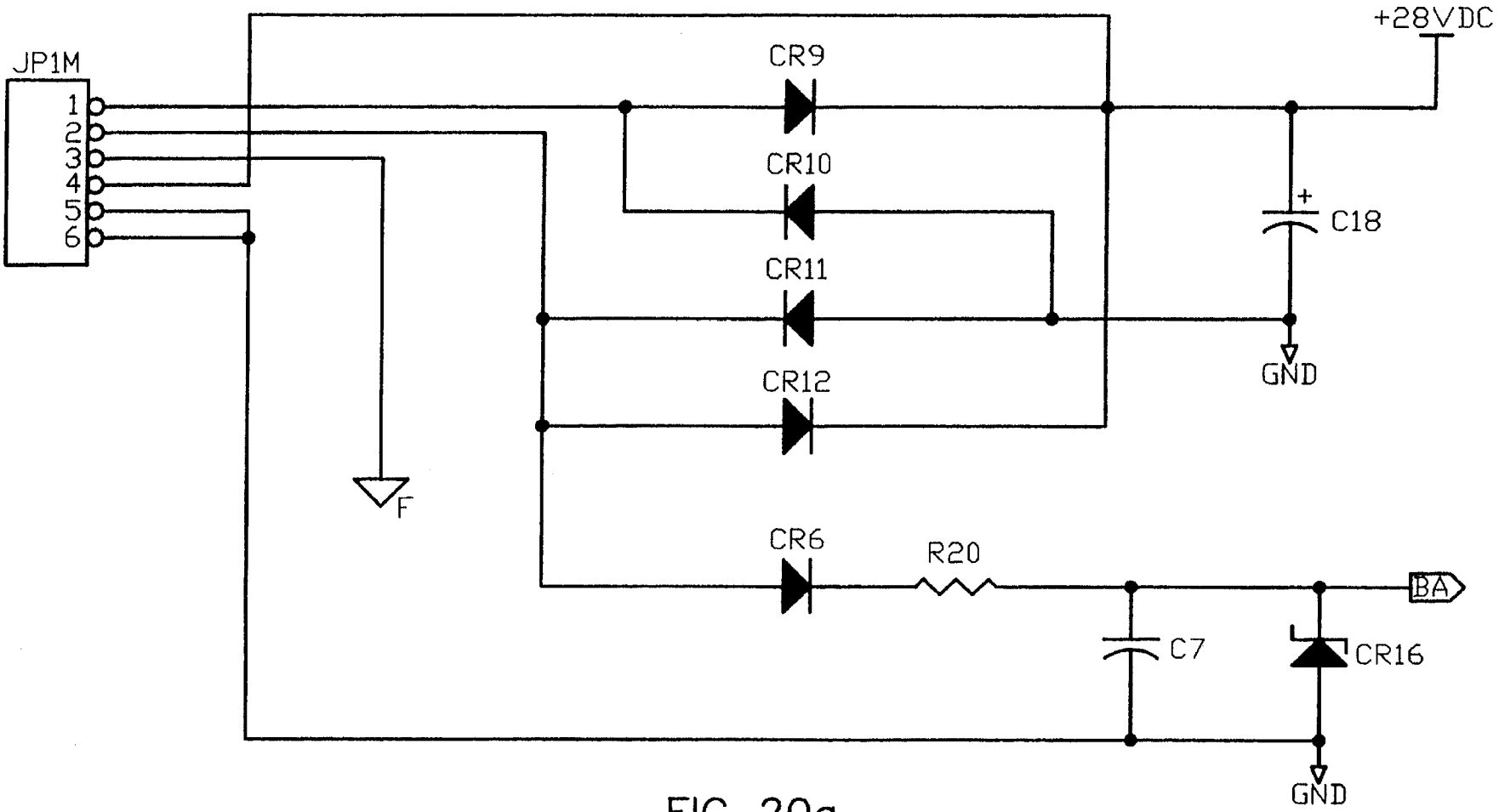
FIGS. 20*a*–20*f* is a schematic diagram of the analog circuitry consisting of the motor drive bridge circuit, torque feedback circuit, torque limit circuit, and rectifier circuit.
Figure 20B:
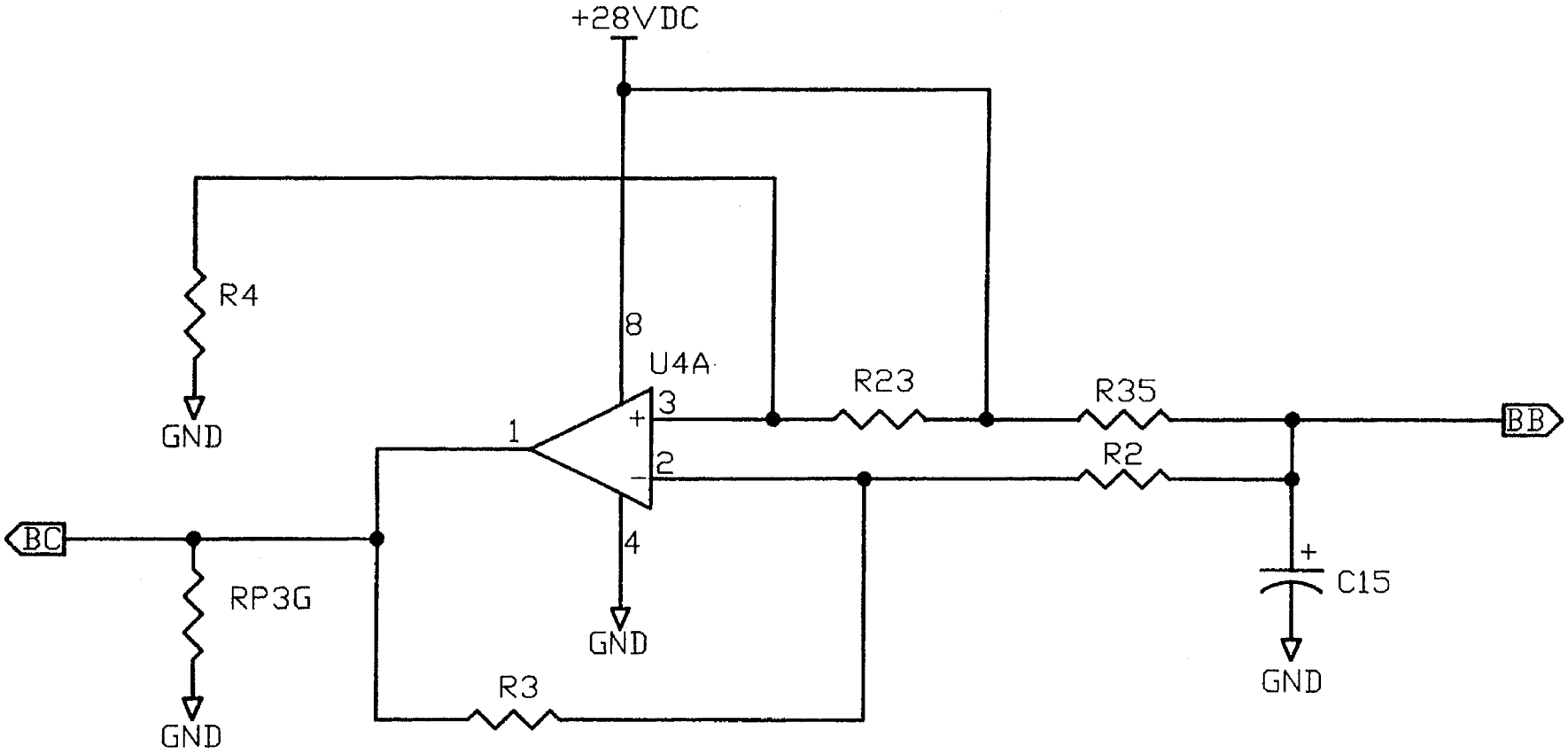
Figure 20C:
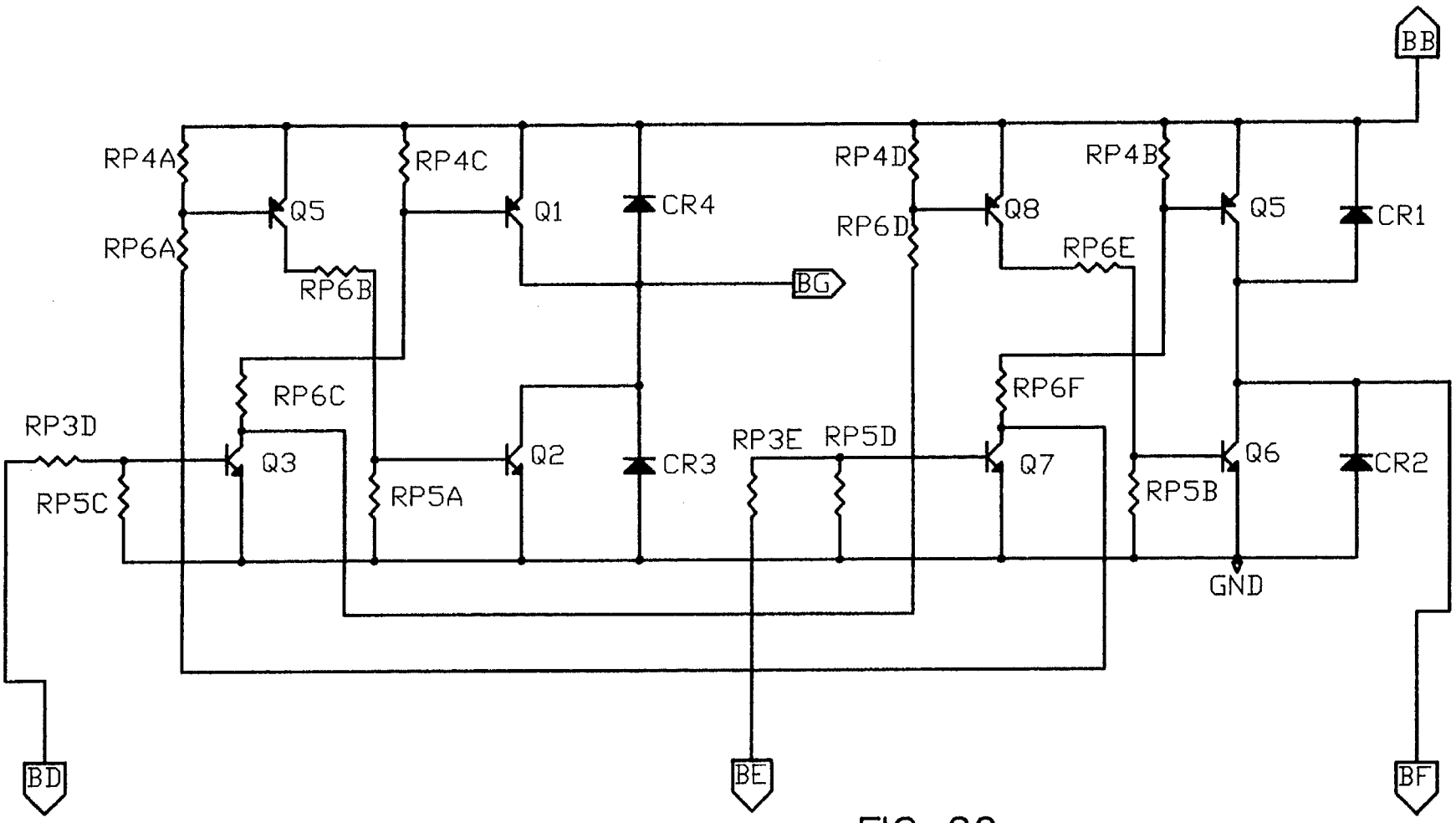
Figure 20D:
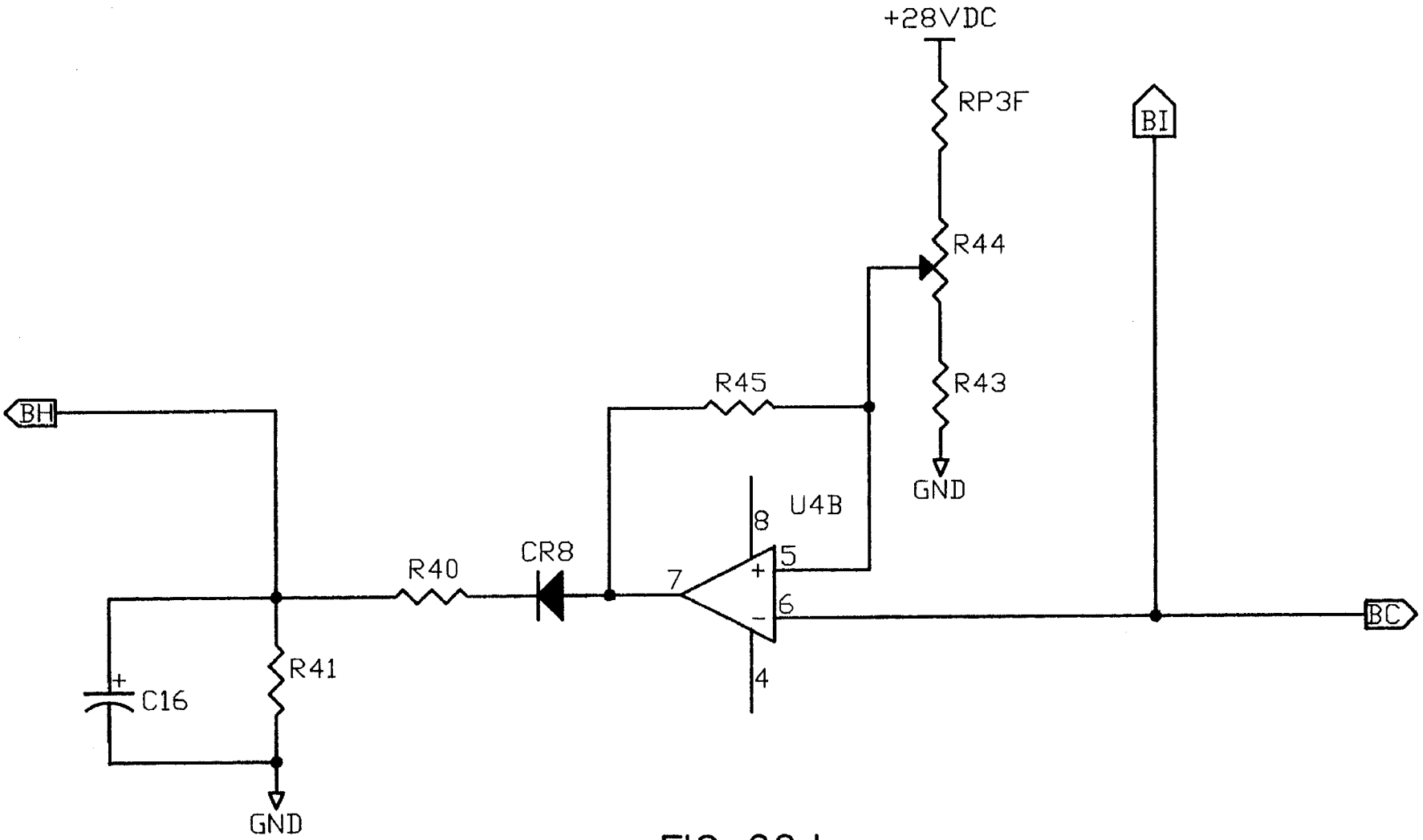
Figure 20E:
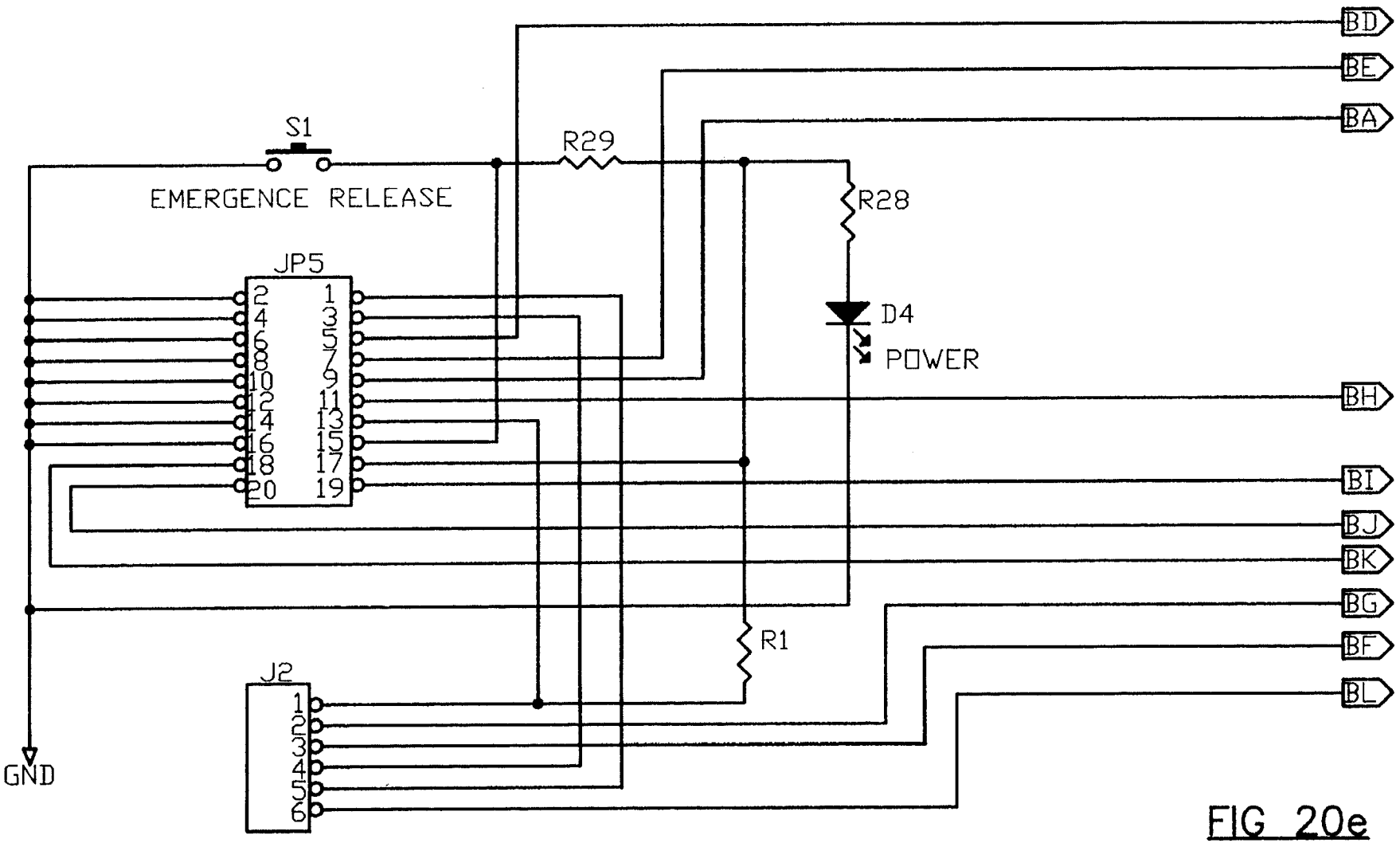
Figure 20F:
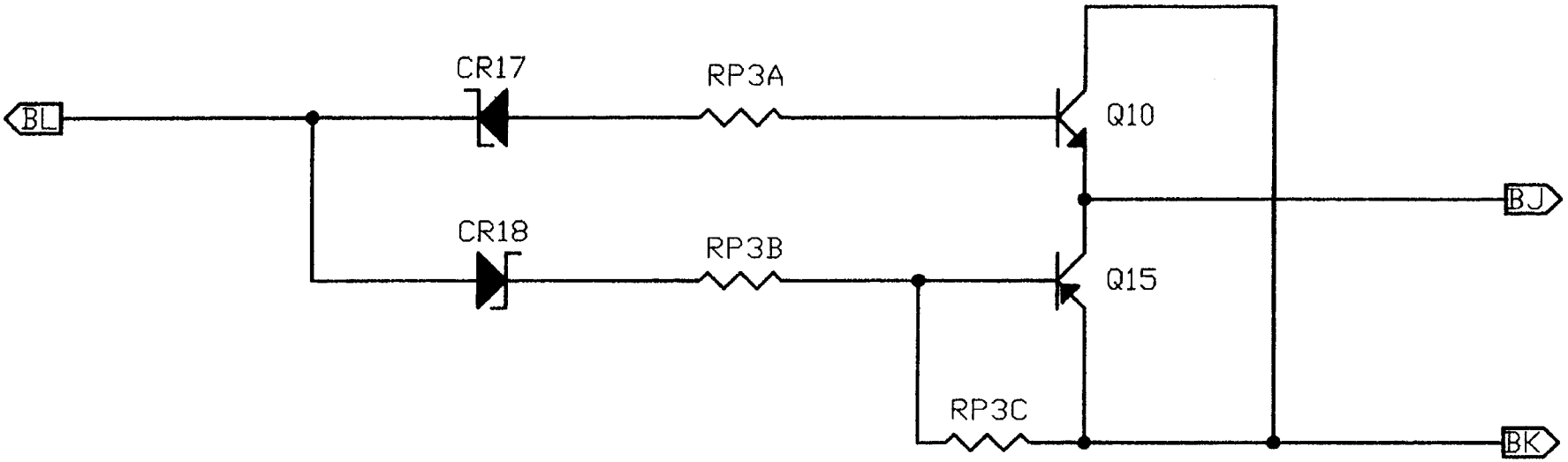
Figure 21A:
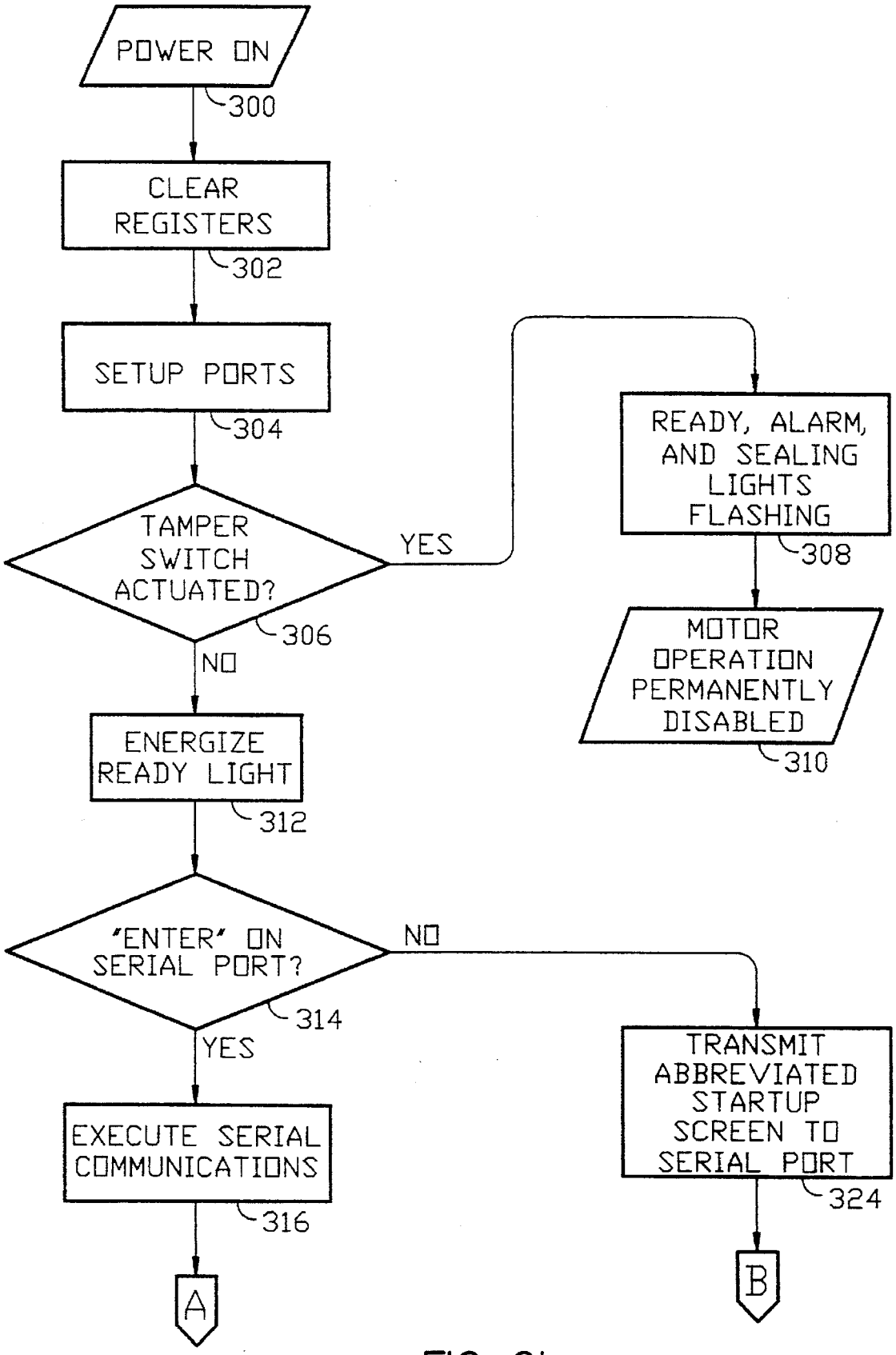
FIGS. 21*a*–21*b*, 22*a*–22*b*, and 23 are a flow diagram showing the software used in the central processing unit.
Figure 21B:
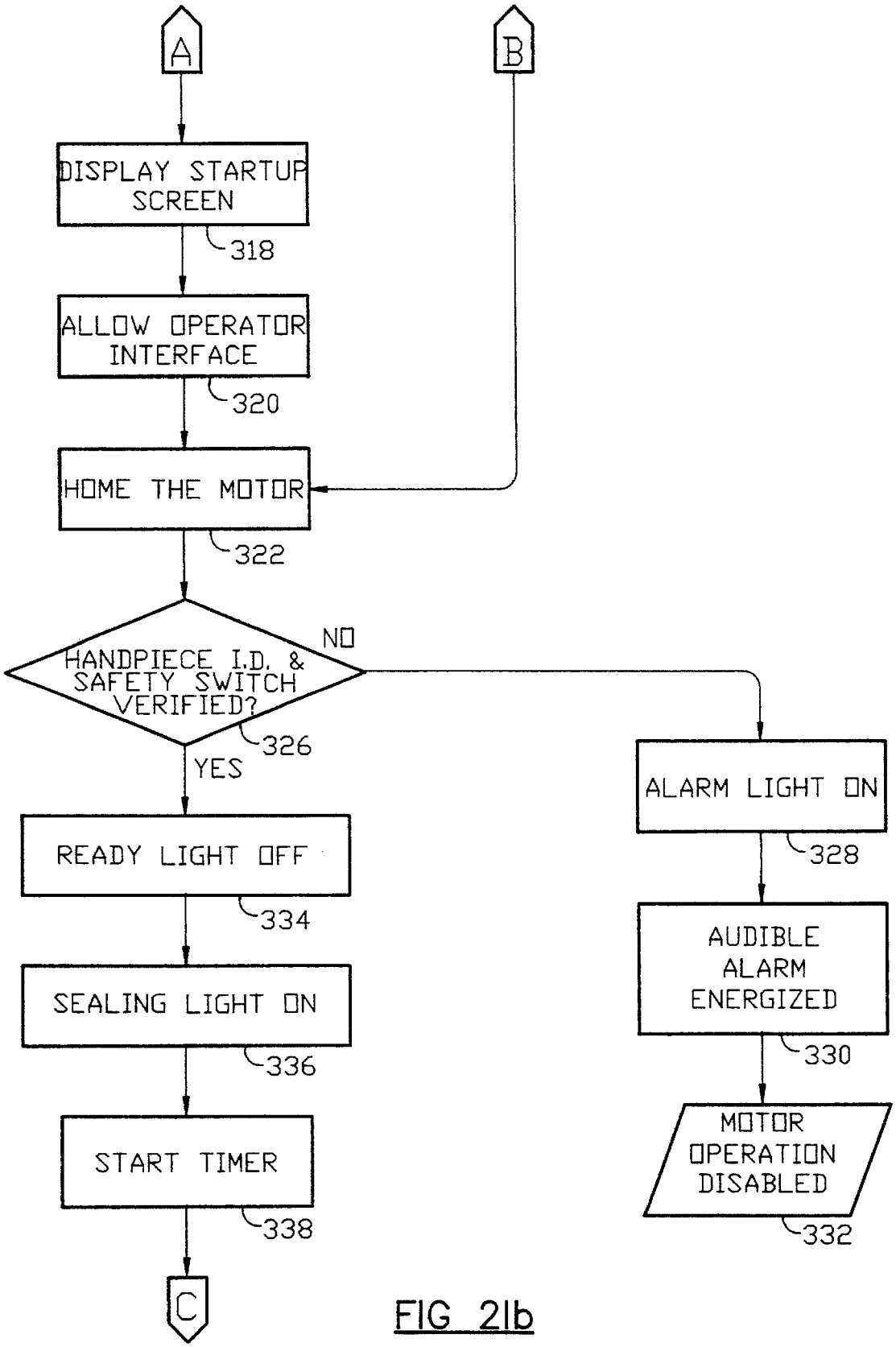
Figure 22A:
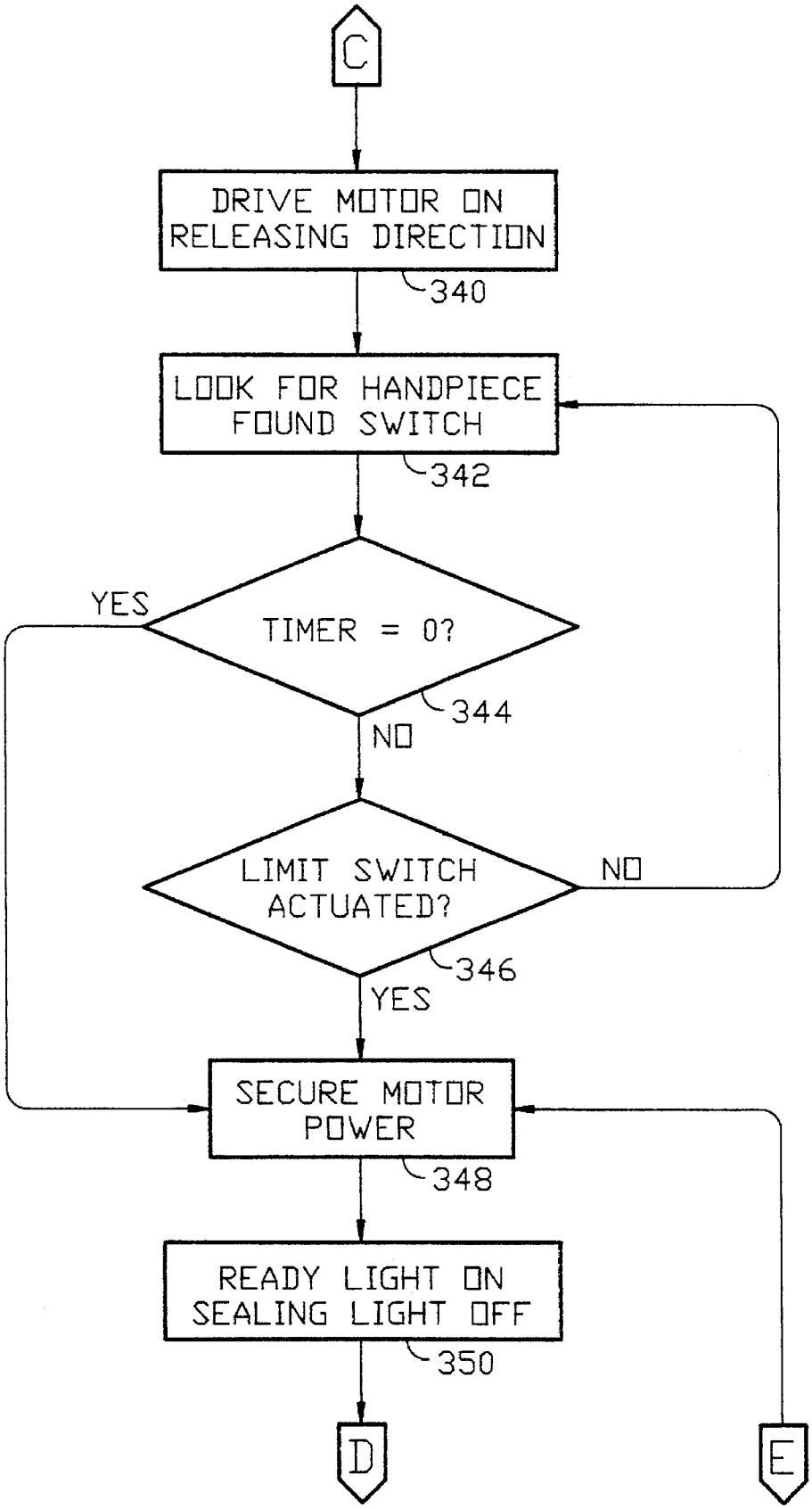
Figure 22B:
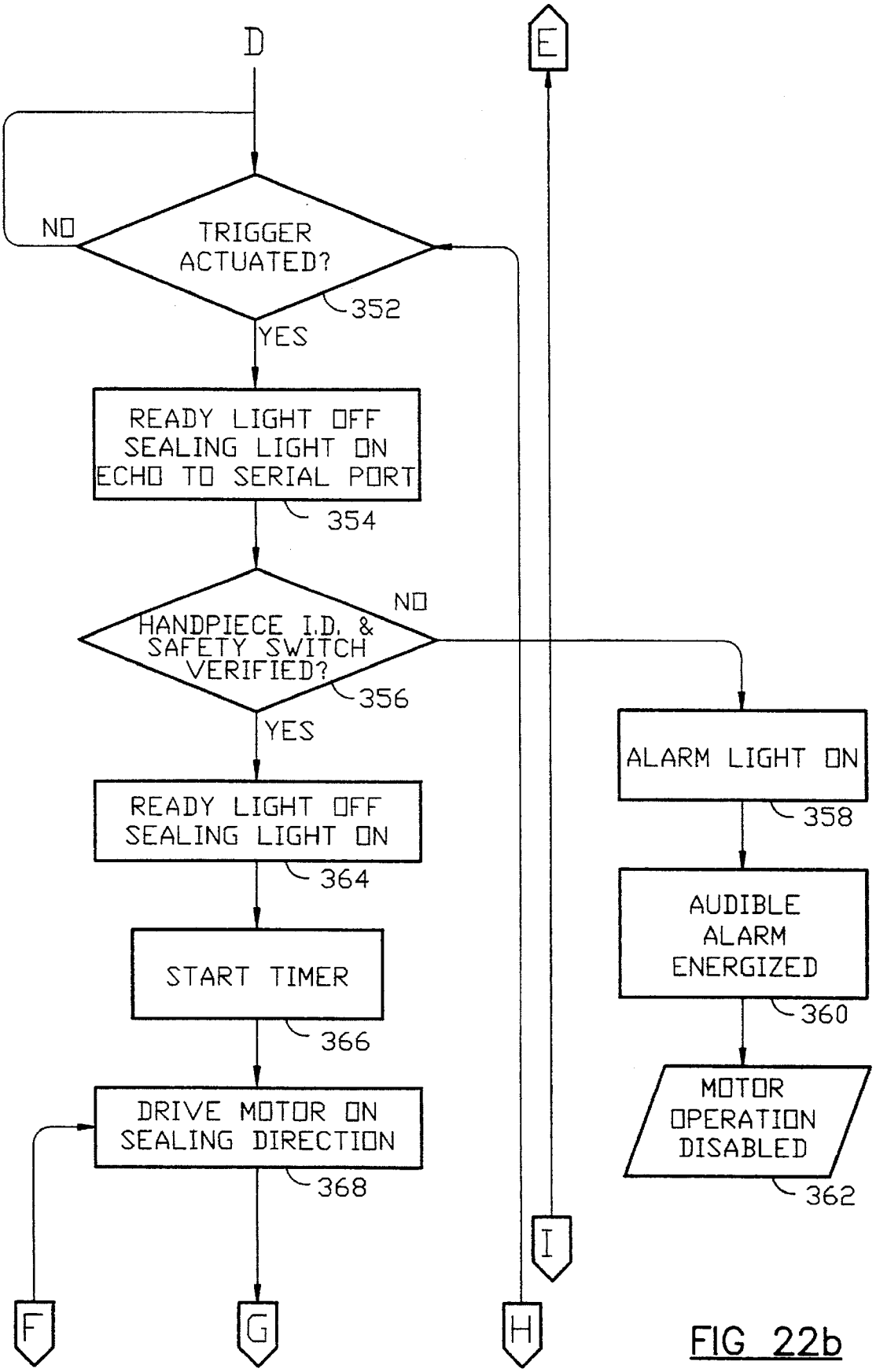
Figure 23:
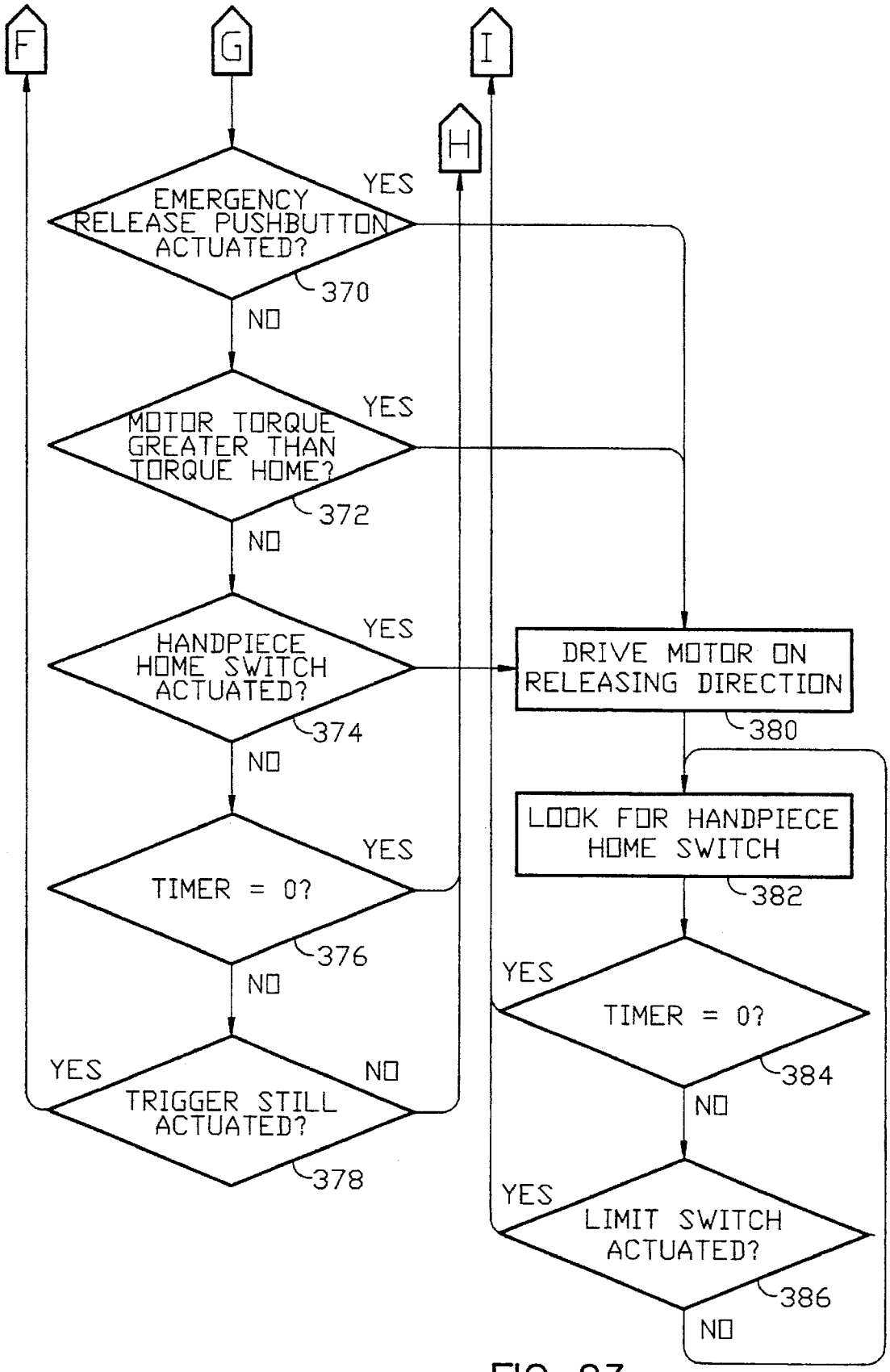

FIG. 18 shows a block diagram of the operational circuits shown FIGS. 19*a*–*i* and 20*a*–*f* used to drive the hand unit 54 to specific user-selected operational parameters. The main operational component of the drive system, shown in FIG. 18, is the central processing unit or CPU 200. The CPU 200 consists of a programmable 8 bit micro controller CPU1. The CPU further comprises a bi-directional input/output (I/O) on-board ram and approximately four kilobits of E-PROM with an analog to digital (A/D) convertor. The CPU 200 directly or indirectly controls all facets of operation of the hand-held unit 54. The CPU receives an input from the power on reset circuit 206 for startup and the torque feedback circuit 214, torque limit circuit 216 and motor clutch sensing circuit 208 for motor M1 operation. The CPU maintains bi-directional communication with memory module 202, hand-held device identification circuit 210, operator interface circuits 204, motor drive lockout circuit 218, and the external communication port 226. CPU 200 provides an indirect output or control to the motor drive lockout circuit 218 for motor M1 control.

The memory circuit 202, associated with the CPU, is a real time clock and random access memory integrated circuit which features the complete time of day clock with calendar and fifty bits of internally battery packed low power static RAM. The memory is used to store torque limits, time out parameters, and usage parameters selected by a user or maintenance facility.

User parameters are generally input through the external communication port 226. This external communications capability is provided through a standard RS-232 transmitter/receiver, and a connection port U3. Interrupts are included in the software used with the CPU 200 to allow serial communications between CPU 200 and any DOS-compatible personal computer. Direct communications with the CPU 200 are necessary to permit setting of torque limits, time out parameters, dates/time, and low level maintenance software for individual units.

Operator interface circuity 204 allows a user to control and monitor the on/off operation of hand-held unit 54 in specific situations. Operator interface circuity 204 consists of a key lock switch S2 shown in FIG. 16, emergency resets switch S1, a safety shield kill switch S5, visual indicator lights D1, D2, D3 and an audible alarm DZ1. The key lock switch S2 is a standard single pole single throw switch which allows a user to initiate operation of the unit through the insertion of a standard key and lock method. After a key is inserted into the switch, a rotation of the switch allows power to the unit to be supplied through the plug J1 shown in FIG. 16. The emergency reset switch S1 is used to position the guide block 80 of the sealing mechanism into its home position shown in FIG. 11. In the event a user's hand or clothing were to be drawn into the unit, the emergency reset switch S1 would be actuated so as the die members 84 and 85 are positioned for immediate retraction of the object from the channel L. The safety shield kill switch S5, positioned under the cylindrical safety collar member 105, acts to disable the motor M1. When the collar is rotated into a position that access to the guide block 80 may be obtained, switch S5 with actuator member S5*a* is moved into an open position, disabling power to motor M1. Rotating the cylindrical safety collar 105 from this position acts to close switch S5.

Finally, visual and audible indications are provided through visual indicator lights D1–D4 which provide individual LED indication for an alarm condition, sealing condition, or ready condition. The alarm condition occurs when the hand-held unit 54 is either intentionally or inadvertently disconnected from the drive circuitry. This condition initiates both the visual alarm at LED D1 and actuates audible alarm module BZ1. After the hand unit has been activated with power applied to the control circuitry, LED D2 is activated indicating a ready condition. During the retraction of a guide block 80, a third LED D3 is illuminated indicating that the hand-held unit of 54 in the sealing mode.

A motor drive lock-out circuit 218 is also attached and is in uni-directional communication with CPU 200. The motor drive lock-out circuit consists of a dual AND gate integrated circuit U6 and pull down resistors R8 and R9. A series of AND gates U6A, U6D receive input from the power on reset circuit 206, the torque limits circuit 216 and the CPU 200. The motor drive lock-out circuit prevents inadvertent operation of motor M1 due to spurious signals which may occur during a start-up of the motor. Motor drive lock-out circuit 218 also determines the direction of the motor-based on an output signal from CPU 200.

The power on reset circuit 206 acts to ensure that the +5 VDC power supply U5 is stable before CPU 200 begins operation. The circuit consists of a supervisory integrated circuit U2 and a number of external timing components, viz, capacitors C5, C6, C8 and resistor R33. Resistor R22 and transistor Q9 provide input to the motor drive lock-out circuit 218 and act as a safety mechanism, preventing spurious signals such as voltage spikes or fluctuations from occurring during power up. Prevention of these signals ultimately prevents the unintentional rotation of the motor M1 within the hand-held unit 54.

A torque limit circuit 216 provides inputs signals to both the CPU 200 and motor drive lock-out circuit 218. The torque limits circuit 216 consist of a low power operational amplifier U4B acting as a comparator. Inputs to the comparator are provided from the output of the torque feedback circuit 214 and a resistor ladder consisting of resistors RP3F, R44, and R43. Resistor R44 is a potentiometer and is adjusted to establish a hardware torque limit. This provides a fail-safe measure in the event the torque value input using the software in CPU 200 becomes corrupted during operation or is set too high prior to initial testing and setup. The torque limits circuit 216 further provides an on/off, i.e. high/low output to CPU 200 and the motor drive lock-up circuit 218. These signals halt the motor M1 operation if the input signal from the torque feedback circuit 216 exceeds the input from the resistor R44. Resistor R45 provides comparative feedback while diode CR8 prevents external signals from effecting operation of the comparator U4B. Resistor R40 is a current limiter. A capacitor C16 and resistor R41 provided peak detector with a decay sufficiently lengthy to ensure that CPU 200 detects a trip of the comparator circuitry U4B even though the operation of the hand-held unit motor slip clutch sensing unit 204 may reduce the current draw of the motor.

An analog voltage signal is developed by the torque feedback circuit 214 and is transmitted as input to an A/D convertor on board the CPU 200. The lower power operational amplifier U4A develops an output signal directly proportional to the voltage drop across resistor R35 which in turn is directly proportional to the current flow through the main drive transistors in the motor drive bridge circuit 212. This provides all of the available current to the hand-held unit motor M1. Resistors R2, R3, R4 and R23 control the gain and the feedback of the comparator U4A. Capacitor C15 stabilizes the voltage drop across the motor M1 in order to maintain a repeatable, relatively constant motor speed. Resistor RP3G holds the comparator U4A output high, corresponding to zero torque when there is no current flow through resistor R35. This is to prevent the comparator U4A output from floating at an unknown level when the motor M1 is in an on/off state. A resistor R30 in conjunction with zener diode CR13 is present to protect the CPU 200 input port by limiting the output of the comparator U4A to the input of CPU 200.

The motor drive bridge circuit 212 directs 28 volt DC directly from the bridge rectifiers CR9–CR12, to the motor M1 in the proper polarity to drive the motor M1 in a forward or reverse direction. Transistors Q1, Q2, Q5 and Q6 are main drive transistors, while transistors Q3, Q4, Q7, and Q8 are control transistors. Resistor RP3, RP4, RP5, and RP6 provide pull-up and current limitation to the main drive and control of the control transistors. Diodes CR1, CR2, CR3, and CR4 provide inductive feedback protection to the main drive transistors.

The motor clutch sensing circuit 208 consists of a mechanical clutch (not shown) located within the motor M1. The mechanical clutch opens and closes a set of switch contacts which are set at a predetermined mechanical torque limit and act to open if the torque limit is exceeded. The motor clutch sensing circuit 208 consists of diodes CR17, CR18, transistors Q10, Q15 and a resistor RP3 which senses the switch activation to provide input to the CPU 200. In the event an over torque condition is sensed, CPU 200 activates the motor drive lock-out circuit 218 to stop the motion of the motor M1.

A hand-held device ID circuit 210 is also attached to the hand-held unit 54 and consists of transistor Q13, diode CR7 and resistors R5, RP2B, RP2A, and zener diode CR22. A 48 bits serial number integrated circuit U7 acts to provide a dual communication line that links CPU 200 with the hand-held unit 54. This utilizes a one-wire communications protocol. Zener diode CR22 protects the IC from transients generated by the motor M1 during start-up or stopping.

Each of the circuits shown in FIG. 18 is powered by a rectifier circuit and a DC power supply circuit shown in FIGS. 20*a –f*. The rectifier circuit provides unit unidirectional voltages and current developed from the AC power supply stepdown transformer T1 via a full wave bridge rectifier CR9, CR10, CR11, and CR12. A capacitor C18 minimizes DC voltage transients during the operation of motor M1. The rectifier circuit further includes a diode CR6 of resistor R20, capacitor C7 and diode CR16 which generate an input that indicates the key-lock switch S2 in (FIG. 16) is in the on position.

A DC power supply circuit is attached to the rectifier circuit and is fused to provide both a regulated +5 VDC and +12 VDC. The regulated +5 VDC is used to power CPU 200, memory circuit 202, power on reset circuit 206, and motor drive lockout circuit 218. This voltage is provided directly from the switching regulator integrated circuit U5. A capacitor C14 stabilizes the voltage, while resistors R31 and R32 limits the voltage of either network which provides the feedback signal to the voltage regulator CR14. The unregulated +12 VDC is used to drive the audible alarm BZ1 and the motor clutch sensing circuit 208 and is developed from zener diode CR21 and resistor R7. The torque feedback circuit is the only component not powered by the DC power supply circuit since it derives its 28 volt unregulated voltage directly from the rectifier circuit. The circuits shown in FIGS. 19*a–i* and 20*a–f* are interconnected using a ribbon cable (not shown) between converters JP3 and JP5.

FIGS. 21*a*–23 illustrate a flow diagram of the operation of the hand-held unit 54 used with the electric system shown in FIG. 18. Specifically, this flow diagram depicts a partial overview of the software used within CPU 200. Once the power is activated 300, the registers in CPU 200 are cleared 304 and the ports are setup for use 304. If the tamper switch is actuated 306, a ready and alarm signal lights flash 308 and the motor is then permanently disabled 310. If the tamper switch is not actuated, the energy ready light is activated 312 and data is ready to be entered on a serial port 314. If data is not entered on a serial port, an abbreviated start-up screen maybe transmitted to the serial port 324 which homes the motor 322. If data is entered on the serial port, the serial communications 316 may commence which displays on a start-up screen 318. The operator interface 320 is then able to home the motor 322. If the hand-held device ID and safety switch are not verified 326 an alarm light is actuated 328. An audible alarm is then energized 330 and the motor is disabled 332. If the hand-held unit ID and safety switch is verified 326, the ready light is disrupted and the sealing light is activated 334.

A start timer is then started 338 and the drive motor is set in a releasing direction 340. A hand-held unit time limit is then analyzed. If the start timer is at zero 344 the motor power is secured 348. If the timer is not at zero, then a time limit switch within CPU 200 is actuated 346 and the handheld unit time limit is reanalyzed 342. The motor power is secured 348 and the sealing light is turned to an off condition and a ready light is turned on 350. If the trigger switch is then actuated 352 the ready light is turned off and the sealing light is turned on. A signal is sent to the serial port 354 and the hand-held device ID while safety switch is then verified 356. If the trigger is not actuated 352 the hand-held unit time limit switch is again determined to be actuated 386. If the time limit is actuated, the motor power is again secured 348 and the sealing light is turned off, ready light turned on 350 and the process begins again. If the time limit switch is not actuated 386, the hand-held unit time limit switch 382 is analyzed 384. If the timer is in a zero state, the motor is then secured 348. If the timer is not in a zero state, the time limit switch is then monitored to determine if actuated 386 and the process begins anew.

After the hand-held unit ID and safety switch are verified 356 the ready light is deactivated and sealing light is activated 364. The start timer 366 starts counting while the motor is run in the sealing direction 368. If the hand-held device ID and safety switch are not verified an alarm light is activated 358, an audible alarm is then energized 360 and the motor operation is disabled 362.

While the motor is run in a sealing direction 368, if the emergency release button is actuated 370, the drive motor is positioned in a releasing direction 380 and the hand-held unit time limit switch is again analyzed 382. A determination is made whether the timer is at zero 384. If at zero, the process begins again when the motor is secured 348. If the timer is not set at zero, the limit switch is analyzed. If the limit switch is actuated the process begins again when the power is activated at the motor 348. If the time limit switch is not actuated 386, the hand-held unit time limit switch is then again analyzed 382 until the timer is set at zero 384. If the emergency release push button is not actuated 370, the motor torque is analyzed to determine if it is greater than the torque limit 372. If the torque is greater, the motor is positioned in a releasing direction 380, wherein the process begins to determine or to analyze the hand-held unit time limit switch 382. If the motor torque is not greater than the torque limit 372, the hand-held unit limit switch is then analyzed 374, if actuated the drive motor is positioned in a releasing direction 380. If the handheld unit time limit switch is not actuated 374, the timer is again analyzed to determine if it is at zero 376. If timer at 376 is at zero, the trigger is actuated 352 and the ready light turns off and sealing light turns on 354. If the timer is not at zero 376, the trigger is analyzed to determine if it is actuated 378. If actuated, the motor is again moved in the sealing direction 368. If the trigger is not actuated 378, the ready light again turns off and the sealing light is turned on 354.

The instant invention has been shown and described herein in what it is considered to be the most practical and preferred embodiment. It is recognized, however, that departures may be made therefrom within the scope of the invention and that obvious modifications will occur to a person skilled in the art.

What is claimed is:

1. An electronic system for controlling a motorized apparatus for securing a closure strap used in flexible containers comprising:

means for processing input commands from an external communications port and producing a drive signal therefrom; and means for driving an electric motor which receives said drive signal and produces an actuation signal;

said input commands include torque limits of said motor, motor direction, and operational duration and time out of said means for driving, wherein said actuation signal is used to control the motorized apparatus for securing a closure strap.

2. The system according to claim 1 further comprising means for detecting the torque of said motor and producing a signal representative of said torque.

3. The system according to claim 2 further comprising means for limiting which disables said means for driving if a predetermined value of said representative torque signal is exceeded.

4. The system according to claim 1 further comprising means for controlling which communicates with said processing means and acts to prevent said motor from inadvertently operating from spurious signals during activation of said system.

5. The system according to claim 1 further comprising means for stabilizing communication with said processing means and acting to stabilize a power supply voltage to said means for processing for prevention of unintentional rotation of said motor.

6. The system according to claim 1 further comprising means for sensing the closure of a mechanical clutch within said electric motor and acting to inactivate said means for driving if a predetermined torque limit is exceeded.

* * * * *